US008475352B2

(12) United States Patent
Carr

(10) Patent No.: US 8,475,352 B2
(45) Date of Patent: Jul. 2, 2013

(54) SOLIDS DISCHARGE CENTRIFUGAL SEPARATOR WITH DISPOSABLE CONTACT ELEMENTS

(75) Inventor: Robert B. Carr, Brookline, MA (US)

(73) Assignee: Wagner Development, Inc., Monaco (MC)

( * ) Notice: Subject to any disclaimer, the term of this patent is extended or adjusted under 35 U.S.C. 154(b) by 825 days.

(21) Appl. No.: 12/648,625

(22) Filed: Dec. 29, 2009

(65) Prior Publication Data

US 2010/0167899 A1 Jul. 1, 2010

Related U.S. Application Data

(60) Provisional application No. 61/141,040, filed on Dec. 29, 2008.

(51) Int. Cl.
*B04B 11/08* (2006.01)

(52) U.S. Cl.
USPC ..... 494/45; 494/50; 494/56; 494/64; 494/65

(58) Field of Classification Search
USPC ..... 494/37, 46, 50–52, 55–59, 62, 65, 494/67, 83, 84, 45, 64; 210/372–377
See application file for complete search history.

(56) References Cited

U.S. PATENT DOCUMENTS

| | | | |
|---|---|---|---|
| 1,909,188 | A | 5/1933 | Roberts |
| 2,040,351 | A | 5/1936 | Williams |
| 2,094,058 | A | 9/1937 | Bryson |
| 3,239,136 | A | 3/1966 | Hein |
| 3,306,681 | A | 2/1967 | Barringer |
| 3,403,848 | A | 10/1968 | Windsor et al. |
| 3,539,096 | A | 11/1970 | Lewis et al. |
| 3,741,465 | A | 6/1973 | Lincoln |
| 3,770,191 | A | 11/1973 | Blum |
| 3,910,489 | A | 10/1975 | Uden |
| 3,972,514 | A | 8/1976 | Voitsekhovsky et al. |

(Continued)

FOREIGN PATENT DOCUMENTS

| | | |
|---|---|---|
| CH | 604 906 | 9/1978 |
| DE | 35 33 306 | 3/1987 |

(Continued)

OTHER PUBLICATIONS

Carr Powerfuge Brochure, Carr Separations, Inc., undated, p. 1-4.

(Continued)

*Primary Examiner* — Charles E Cooley
(74) *Attorney, Agent, or Firm* — Preti Flaherty Beliveau & Pachios LLP

(57) ABSTRACT

A hermetically sealed solids discharge centrifugal separator having a separator bowl with a cylindrical upper portion and a conical lower portion, an inlet port at the bottom of the bowl and an outlet port at the top of the bowl. A disposable liner assembly includes a bowl liner having a cylindrical upper portion and conical lower portion, such that the bowl liner can conform to the interior surface of the separator bowl. The liner assembly further includes a piston within the bowl liner, the piston having an upper portion that conforms to the bowl liner cylindrical upper portion and a lower portion that conforms to the bowl liner conical lower portion. A fluid pathway extends through the piston, with a shuttle valve disposed within the fluid pathway.

8 Claims, 16 Drawing Sheets

U.S. PATENT DOCUMENTS

| | | | | |
|---|---|---|---|---|
| 4,209,127 | A | 6/1980 | Khapaev | |
| 4,416,655 | A | 11/1983 | Bennett | |
| 4,492,769 | A | 1/1985 | Blanchard et al. | |
| 4,493,768 | A | 1/1985 | Kubr et al. | |
| 4,513,566 | A | 4/1985 | Rajsigl et al. | |
| 4,687,463 | A | 8/1987 | Simonnet | |
| 4,692,247 | A | 9/1987 | Orlans | |
| 4,875,334 | A | 10/1989 | Rajsigl et al. | |
| 4,915,844 | A | 4/1990 | Imamura et al. | |
| 5,250,180 | A | 10/1993 | Chang | |
| 5,328,441 | A | 7/1994 | Carr | |
| 5,356,367 | A | 10/1994 | Carr | |
| 5,364,335 | A | 11/1994 | Franzen et al. | |
| 5,425,698 | A | 6/1995 | Carr | |
| 5,454,777 | A | 10/1995 | Ziems et al. | |
| 5,674,174 | A | 10/1997 | Carr | |
| 5,733,238 | A | 3/1998 | Carr | |
| 5,743,840 | A | 4/1998 | Carr | |
| 5,823,937 | A | 10/1998 | Carr | |
| 5,849,178 | A | 12/1998 | Holm et al. | |
| 5,879,279 | A | 3/1999 | Berger et al. | |
| 5,916,082 | A | 6/1999 | Opfer | |
| 6,123,655 | A * | 9/2000 | Fell | 494/50 |
| 6,126,587 | A | 10/2000 | Berger et al. | |
| 6,149,573 | A | 11/2000 | Berger et al. | |
| 6,224,532 | B1 | 5/2001 | Beattey | |
| 6,248,054 | B1 | 6/2001 | Berger et al. | |
| 6,251,056 | B1 | 6/2001 | Berger et al. | |
| 6,461,286 | B1 | 10/2002 | Beattey | |
| 6,478,724 | B1 | 11/2002 | Beattey | |
| 6,616,590 | B2 | 9/2003 | Kessler et al. | |
| 6,632,166 | B2 * | 10/2003 | Carr | 494/37 |
| 6,733,433 | B1 * | 5/2004 | Fell | 494/37 |
| 6,776,752 | B2 * | 8/2004 | Carr | 494/38 |
| 6,800,053 | B2 * | 10/2004 | Fox | 494/1 |
| 6,932,757 | B2 | 8/2005 | Beattey | |
| 6,986,734 | B2 * | 1/2006 | Carr | 494/46 |
| 7,052,451 | B2 * | 5/2006 | Carr | 494/50 |
| 7,261,683 | B2 * | 8/2007 | Carr | 494/50 |
| 7,261,783 | B1 | 8/2007 | MacKay et al. | |
| 7,618,361 | B2 * | 11/2009 | Carr | 494/37 |
| 7,628,749 | B2 * | 12/2009 | Carr | 494/25 |
| 7,935,042 | B2 * | 5/2011 | Carr | 494/37 |
| 2002/0016243 | A1 * | 2/2002 | Carr | 494/37 |
| 2002/0017483 | A1 | 2/2002 | Chesner et al. | |
| 2002/0082154 | A1 | 6/2002 | Kessler et al. | |
| 2003/0017931 | A1 | 1/2003 | Beattey | |
| 2003/0127391 | A1 | 7/2003 | Craft, Sr. et al. | |
| 2003/0195105 | A1 * | 10/2003 | Carr | 494/38 |
| 2005/0003945 | A1 | 1/2005 | Beattey | |
| 2005/0009681 | A1 * | 1/2005 | Carr | 494/46 |
| 2005/0023882 | A1 | 2/2005 | Burger et al. | |
| 2005/0023883 | A1 | 2/2005 | Okajima | |
| 2005/0043164 | A1 | 2/2005 | Opfer | |
| 2005/0233882 | A1 * | 10/2005 | Carr | 494/50 |
| 2005/0233883 | A1 * | 10/2005 | Carr | 494/50 |
| 2007/0049479 | A1 * | 3/2007 | Carr | 494/23 |
| 2007/0114161 | A1 * | 5/2007 | Carr | 210/96.2 |
| 2010/0029457 | A1 * | 2/2010 | Carr | 494/8 |
| 2010/0167899 | A1 * | 7/2010 | Carr | 494/4 |

FOREIGN PATENT DOCUMENTS

| | | |
|---|---|---|
| EP | 1 028 163 | 8/2000 |
| GB | 400809 | 1/1933 |
| JP | 63-171656 | 7/1988 |
| JP | 7-144150 | 6/1995 |
| JP | 8-131894 | 5/1996 |
| JP | 8-266936 | 10/1996 |
| JP | 9-85189 | 3/1997 |
| JP | 2001-140704 | 5/2001 |
| JP | 2003-144973 | 5/2003 |
| JP | 2008/012375 | 1/2008 |
| WO | WO 00/38762 | 7/2000 |
| WO | WO 02/02236 | 1/2002 |
| WO | WO 2006/046141 | 5/2006 |
| WO | WO 2007/135481 | 11/2007 |

OTHER PUBLICATIONS

Alfa-Laval CHPX Centrifuge Brochure, Alfa Laval, Inc., undated, p. 1.

Shanghai Centrifuge Institute, SCI Tube Bowl Centrifuge, Shanghai, China, undated, p. 1-2.

* cited by examiner

SOLIDS DISCHARGE CENTRIFUGAL SEPARATOR WITH DISPOSABLE CONTACT ELEMENTS

CROSS REFERENCE TO RELATED APPLICATIONS

This application claims the priority of U.S. Provisional Application No. 61/141,040, filed Dec. 29, 2008 entitled, SOLIDS DISCHARGE CENTRIFUGAL SEPARATOR WITH DISPOSABLE CONTACT ELEMENTS, the whole of which is hereby incorporated by reference.

BACKGROUND OF THE INVENTION

Many different types of centrifugal separators are known for separating heterogeneous mixtures into components based on specific gravity. Typically, a heterogeneous mixture, which may also be referred to as feed material or liquid, is injected into a rotating bowl of a centrifugal separator. The rotating bowl spins at high speeds and forces components of the mixture that have a high specific gravity to separate therefrom by sedimentation. As a result, dense solids compress as a cake tightly against an inner surface or wall of the bowl and clarified liquid, or centrate, forms radially inward from the cake. The bowl may spin at speeds sufficient to produce forces 20,000 times greater than gravity so as to separate the solids from the centrate. As solids accumulate along the wall of the bowl, the centrate exits from the bowl and leaves the separator. Once a desired amount of solids has accumulated, the separator is placed in a discharge mode in which the solids are removed from the separator. Often, for example, an internal scraper is engaged to scrape the solids from the walls of the bowl.

Conventional separators have many shortcomings when discharging particular kinds of solids and liquids. For example, some separators may not be capable of completely discharging solids that are sticky, which can result in poor yields. A poor yield can be especially problematic for high-value solids such as those encountered in pharmaceutical processes. Traditional separators also subject a feed material to very high shear forces when accelerating the material to the rotational speed of the bowl, which can damage, for example, sensitive chemical or biological substances such as intact cells. Other separators do not provide a convenient means by which to handle and recover sensitive solids. For example, an operator is commonly required to assist with solids discharge and recovery, introducing the potential for contamination. Furthermore, conventional separators tend to be difficult to clean or sterilize in place, requiring operations that significantly increase maintenance costs and creating the potential for cross contamination between different preparations.

The biotechnology and pharmaceutical industries have come to rely increasingly on disposable process components for production. Disposable, pre-sterilized sample contacting materials offer numerous advantages, including savings in time, labor, and cost for both initial set-up and turn-around between runs. They also dramatically reduce the risk of contamination and simplify process validation. Conventional production scale centrifugal separators suitable for processing cells and other biomaterials require particular care to clean and sterilize in place. Nevertheless, to our knowledge no available separator offers the advantages of fully pre-sterilizable and disposable sample contacting elements.

SUMMARY OF THE INVENTION

In accordance with the present invention, a centrifugal separator is disclosed that efficiently recovers sticky solids and exhibits low-shear filling and acceleration of feed material, while accommodating disposable process contacting elements to eliminate the need for clean-in-place and sterilize-in-place operations. Disposable elements of the separator are made of materials that are inexpensive enough to be considered by the user as suitable for single use, and therefore are generally made of plastic rather than metal, although the presence of some metal, rubber, or other materials in disposable elements is possible. Disposable elements also can be supplied and packaged as pre-sterilized units, and their use can avoid the need for cleaning and sterilizing steps during operation. The separator also can be operated in a hermetically sealed configuration. The separator can be particularly useful for sensitive solids such as chemical or biological substances. A separator of the invention can recover sensitive solids, liquids, materials or combinations thereof without operator intervention or additional mechanical equipment.

The centrifugal separator includes a separator bowl, a separator housing, and a variable speed drive motor. The housing has upper, middle, and lower portions. The middle portion encloses the separator bowl; in some embodiments this portion of the housing is temperature controlled, e.g., through a jacket for cooling liquid flow. The bowl has upper and lower portions. In one embodiment, the upper portion is cylindrical, and the lower portion is conical. The bowl includes an inlet port at the bottom of the bowl and an outlet port at the top of the bowl, or at the top of a spindle shaft extending upward from the bowl. The upper portion of the housing contains an upper bearing assembly that engages the upper portion of the bowl, or a spindle shaft extending upward from the bowl. The lower portion of the housing includes a lower bearing assembly, that engages with the lower portion of the bowl. Some embodiments also include an upper valve and seal assembly that attaches to the outlet port at the top of the bowl or spindle shaft. Some embodiments also include a lower valve and seal assembly that attaches to the inlet port at the bottom of the bowl. In certain embodiments, the separator can also be fitted with a piston position sensing optical system for precise and automated regulation of solids discharge cycles.

The lower valve and seal assembly contains a feed port, a solids discharge port, and a valve for switching flow from either the feed port or the solids discharge port to the inlet port in the bottom portion of the bowl. In one embodiment, the valve is a three-way ball valve. The lower valve and seal assembly also contains one or more seals for hermetically sealing the separator housing at the lower bearing assembly against the lower portion of the bowl, or an extension from the lower portion of the bowl.

The upper valve and seal assembly contains a centrate port and an optical port, as well as a valve for switching access to the outlet port between a centrate port and an optical port for use with a laser piston position sensing system. In one embodiment, the valve is a three-way ball valve. The upper valve and seal assembly also contains one or more seals for hermetically sealing the separator housing at the upper bearing assembly against the upper portion of the bowl or a spindle shaft extending from the upper portion of the bowl.

Another aspect of the present invention is a cylindrical separator bowl having an upper portion that can be, for example, cylindrical in form and a lower portion that can be, for example, conical in form. The lower portion of the bowl has an inlet port, for example, at the bottom of the bowl, through which feed material or liquid is injected during a feed mode of operation. As the bowl rotates at a high speed, the injected feed liquid encounters a sloped surface of the conical lower end of the bowl. Rotational acceleration forces are imparted gradually as the liquid moves radially outward.

Solids then separate from the feed liquid and accumulate along the inner surface of the bowl, for example, as a cake. An integral spindle shaft extends from the top of the bowl, above the cylindrical upper portion of the bowl; the spindle shaft can engage a drive mechanism for the separator bowl, such as a drive belt attached to a motor. An outlet port at the top of the spindle shaft allows fluid, e.g., centrate, to exit the bowl. In some embodiments, the separator bowl is devoid of further inlet or outlet ports between the inlet port at the bottom of the bowl and the outlet port at the top of the bowl, or at the top of the spindle shaft, so as to minimize shear forces experienced by a sample within the bowl.

The bowl further includes a piston disposed within the bowl in tight-fitting relationship with an inner surface of the bowl. The piston features an upper portion that can be, for example, cylindrical in form, and a lower portion that can be, for example, conical in form. The piston is contacted by a fluid exerting pneumatic or hydraulic pressure against the piston during different modes of separator operation. For example, in a solids discharge mode, fluid such as compressed gas or hydraulic liquid acts against the upper portion of the piston urging it axially downward to force accumulated solids from the bowl via the opening in the conical lower end thereof. Exemplary types of compressed gas for moving the piston include nitrogen and argon. Similarly, an exemplary hydraulic liquid for moving the piston in the bowl can include distilled water. In one embodiment, the lower end of the bowl and the lower portion of the piston have complementary shapes to promote relatively complete discharge of solids. For example, the lower portion of the bowl and lower portion of the piston can feature substantially conical or frustoconical shapes.

Certain embodiments of the separator bowl are also equipped with a disposable bowl liner. The use of a disposable bowl liner can eliminate the need for clean-in-place and sterilize-in-place operations. Consequently, the disposable bowl liner of the present invention has several advantages over previous designs, including reduced setup and turnaround times, reduced or eliminated batch-to-batch contamination, easier validation, and lower labor costs. In embodiments employing a disposable bowl liner, the lower portion of the separator bowl usually can be removed from the upper portion of the bowl to enable replacement of the disposable bowl liner. The disposable bowl liner typically will contain a disposable piston, such as described above, within the bowl liner cavity. When a bowl liner is used in a separator bowl, the piston moves within the bowl liner and is used to displace accumulated solids from the inner surface of the bowl liner, rather than from the bowl itself. When a bowl liner is used, the separator bowl serves as a structural element to support the bowl liner. In some embodiments the separator bowl can also be equipped with a disposable lower valve and seal assembly and/or a disposable upper valve and seal assembly. These assemblies can mediate the switching of fluid pathways for filling and draining the bowl, and also can provide hermetic seals that prevent bowl contents leaving the bowl interior, and prevent environmental contaminants or microbes from entering the bowl, thereby ensuring the sterility and purity of bowl contents and protecting the external environment from contamination by bowl contents.

Another aspect of the present invention is a piston assembly for a solids discharge centrifugal separator. The piston includes an upper portion and a lower portion. The lower portion conforms to the inner surface of the lower portion of a separator bowl, such as the bowl described above. In some embodiments, the upper portion of the piston also substantially conforms to the upper portion of a separator bowl. In one embodiment, the upper portion of the piston is cylindrical and the lower portion of the piston is conical. The piston contains a fluid pathway for transport of a fluid, such as feed liquid, centrate liquid, or a drive fluid through the piston. Disposed within the piston, and situated within the fluid pathway, is a shuttle valve that regulates fluid flow through the pathway in response to the pressure across the valve. The fluid pathway contains a first pathway opening at the top of the piston and ending at the upper side of the shuttle valve. The fluid pathway also contains a second pathway opening in the lower portion of the piston and ending at the lower side of the shuttle valve. The shuttle valve seals the first pathway when pressure in the second pathway is greater than the pressure in the first pathway, and seals the second pathway when pressure in the first pathway is greater than in the second pathway.

Yet another aspect of the present invention is a piston position sensing system for a centrifugal separator. The system includes a separator bowl, a piston movably disposed against an inner surface of the bowl, a laser, and a signal processor. The separator bowl contains an axially positioned optical port or window at its top end and an outlet port at its bottom end. The piston contains a mirror positioned on an upper surface of the piston so as to reflect light from the laser back upwards to the signal processor. The position of the piston within the bowl can be determined by the signal processor using a known method such as triangulation, time-of-flight measurement, or interferometry. In one embodiment, the piston contains a fluid pathway through the piston and a shuttle valve disposed within the fluid pathway. In this embodiment, the mirror is mounted on the shuttle valve, or alternatively the shuttle valve has a mirrored surface. In this embodiment, the fluid pathway serves as an optical pathway leading to the mirror on the shuttle valve, which provide piston positional information to the signal processor.

The invention also provides a method for operating a centrifugal separator as described above. In one embodiment, the method includes: (a) flowing feed liquid into the separator bowl through the inlet port; (b) rotating the separator bowl, whereby solid components of the feed liquid accumulate on an inner surface of the bowl; (c) continuing to rotate the separator bowl while flowing feed liquid into the inlet port, whereby clarified centrate liquid flows out through the outlet port; (d) stopping bowl rotation and draining residual liquid from the bowl through the inlet port; and (e) flowing a fluid back through the outlet port, whereby the piston is displaced downward within the bowl and accumulated solids are discharged through the inlet port. In certain embodiments the method further includes: (f) flowing a fluid into the inlet port, whereby the piston is displaced upward in the bowl, so that further separation cycles can be performed.

Another aspect of the invention is a method for operating a centrifugal separator having a shuttle valve within the piston, and having upper and lower valve assemblies as described above. The method includes: (a) flowing feed liquid into the separator bowl through the feed liquid port of the lower valve assembly; (b) rotating the separator bowl, whereby solid components of the feed liquid accumulate on an inner surface of the bowl; (c) continuing to rotate the separator bowl while flowing feed liquid into the feed liquid port at a flow rate sufficient to maintain the shuttle valve in an open configuration, whereby clarified centrate liquid flows out through the centrate valve; (d) stopping bowl rotation and draining residual liquid from the bowl through the feed liquid port, whereby the shuttle valve assumes a closed configuration; (e) purging liquid from the liquid pathway through the piston, the spindle shaft, the upper valve assembly, and the centrate port by flowing a fluid into the bowl through the feed liquid port at a flow rate sufficient to maintain the shuttle valve in an open configuration; (f) switching the lower valve assembly to open a pathway from the inlet port to the solids discharge port and flowing a fluid back through the centrate port at a rate sufficient to drive the shuttle valve into a closed configuration, whereby the piston is displaced downward within the bowl, and accumulated solids are discharged through the solids discharge port. In certain embodiments the method further includes: (g) switching the lower valve assembly to open a pathway from the feed liquid port to the solids discharge port and flowing a fluid into the feed liquid port, whereby residual solids are purged through the solids discharge port; and (h) switching the lower valve assembly to open a pathway from the feed liquid port to the inlet port and flowing a fluid into the feed liquid port, whereby the shuttle valve assumes a closed configuration and the piston is displaced upward in the bowl. In this embodiment, the piston is reset and the separator is able to perform another separation cycle.

Another aspect of the invention is a bowl liner assembly for a solids discharge centrifugal separator. The assembly includes a bowl liner, a hollow central core, a first piston assembly, and a second piston assembly. The bowl liner conforms to the inner wall of the bowl of the separator. The separator bowl includes an upper portion, a cylindrical middle portion, and a conical lower portion. The upper portion of the bowl includes a spindle shaft capable of engaging a drive motor. The spindle shaft terminates at its upper end in an outlet port, and the lower portion of the bowl includes a cylindrical extension terminating at its lower end in an inlet/solids discharge port. The bowl liner extends continuously from the inlet port to the outlet port, and forms the entire sample contacting surface along the walls of the bowl. The hollow central core is disposed about the central axis of the bowl and extends from the liner at the spindle shaft to the liner at its lower extension. The first piston is movably disposed within the liner and conforms to the inner surface of the liner. The first piston also surrounds the central core. The second piston is movably disposed within the central core and conforms to the inner surface of the central core. The second piston is capable of extension through the cylindrical extension to discharge the last remaining solids from the bowl, after the first piston has extruded the bulk of the solids from the bowl. The bowl liner and other components of the assembly each optionally may be made of plastic, and the bowl liner assembly is preferably configured as a single disposable unit, which can be provided in pre-sterilized condition. In certain embodiments, the central core is fitted with channels for a driving fluid or gas that drives one or both of the first and second pistons. In a preferred embodiment, the liner assembly is configured for use with a separator bowl that possesses a removable lower end, thereby permitting the bowl to be opened for replacement of the bowl assembly.

Yet another aspect of the invention is a dual piston separator bowl assembly for a solids discharge centrifugal separator. The assembly includes a separator bowl, a hollow central core, a first piston, and a second piston. The separator bowl includes an upper portion, a cylindrical middle portion, and a conical lower portion. The upper portion of the bowl includes a spindle shaft capable of engaging a drive motor. The spindle shaft terminates at its upper end in an outlet port, and the lower portion of the bowl includes a cylindrical extension terminating at its lower end in an inlet/solids discharge port. The hollow central core is disposed about the central axis of the bowl and extends from the spindle shaft to the lower extension of the bowl. The first piston is movably disposed within the bowl and conforms to the inner surface of the bowl. The first piston also surrounds the central core. The second piston is movably disposed within the central core and conforms to the inner surface of the central core. The second piston is capable of extension through the cylindrical extension to discharge the last remaining solids from the bowl, after the first piston has extruded the bulk of the solids from the bowl. In certain embodiments, the bowl assembly includes a bowl liner, or is configured for use with a replaceable bowl liner. In some embodiments, the lower end of the bowl is removable to allow components within the bowl to be exchanged.

Still another aspect of the invention is a centrate valve assembly for a solids discharge centrifugal separator. The assembly includes a centrate valve and a solids discharge piston actuator. The centrate valve has an open position and a closed position. In the open position, the valve is capable of directing flow of centrate from the separator to a centrate port for collection. In the closed position, the centrate valve stops flow of centrate from the separator. The solids discharge piston actuator is capable of moving a piston within a separator bowl of the separator so as to discharge solids from the bowl. The centrate valve and piston actuator are combined into a single assembly, which is preferably configured as a disposable unit and can be provided in a pre-sterilized condition. In certain embodiments, the centrate valve assembly also includes a seal assembly that hermetically seals the outlet port to the separator. In certain embodiments, the valve assembly has one or more ports for cooling liquid and channels to allow flow of cooling liquid through the assembly, such as to cool the seals. In certain embodiments, the piston actuator includes a piston position sensor. In certain embodiments, the assembly also includes one or more ports to supply a driving fluid or gas for driving the movement of a piston within the bowl.

Another aspect of the invention is a feed/discharge valve assembly for a solids discharge centrifugal separator. The assembly includes a feed port, a solids port, and a three-way valve. The feed port is capable of forming a connection to a feed line for introducing feed material into the separator. The solids port can form a connection to a solids collection vessel, which is used to collect solids that have been separated from the feed material by the action of the separator. The three-way valve has a first open configuration and a second open configuration. In the first open configuration, the valve directs feed liquid from the feed port into the inlet port at the lower end of the separation bowl of the separator. In the second open configuration, the valve provides a pathway from the inlet port to the solids port. The pathway conforms to a solids discharge piston present within the separator bowl. The piston is used to extrude residual solids from the bowl out through the valve and the solids port. The feed/discharge valve assembly is preferably configured as a disposable unit, which can be provided in a pre-sterilized condition. In certain embodiments, the feed/discharge valve assembly also includes a seal assembly that hermetically seals the inlet port to the separator. In certain embodiments, the valve assembly has one or more ports for cooling liquid and channels to allow flow of cooling liquid through the assembly, such as to cool the seals. In certain embodiments, the three-way valve rotates to switch between the first and second open configurations. In some embodiments the second open configuration pathway is at least 10 mm in diameter, while in other embodiments, intended for use with thicker solid pastes or larger separations involving a greater mass of solids, the pathway is at least 30 mm in diameter.

Still another aspect of the invention is a piston position sensing system for a solids discharge centrifugal separator. The system includes a separator bowl, a piston within the bowl, a light source, and a signal processor. The separator bowl has a peripherally positioned optical port integrated into the upper portion of the bowl. The piston is movably disposed against an inner surface of the bowl. The piston has a light reflective surface on its upper portion, which is capable of reflecting light from the light source back up through the optical port to the signal processor. The light reflective surface is aligned with the optical port to provide a continuous optical path through the bowl to the piston. The light source is positioned outside the bowl, and it illuminates the reflective surface on the bowl through the optical port during at least a portion of the rotation of the bowl. The signal processor receives light reflected from the reflective surface back through the optical port and provides an output value that indicates the position of the piston within the bowl. In some embodiments, the system includes a bowl liner having an optical window peripherally positioned in the upper surface of the bowl liner. The window can be a portion of the top of the bowl liner, or the entire top of the bowl liner. If the window is only a portion, it is aligned with an optical port at the top of the bowl.

Yet another aspect of the invention is a dual piston solids discharge centrifugal separator. The separator contains a dual piston separator bowl assembly, which includes a separator bowl, a hollow central core, a first piston, and a second piston. The separator bowl has an upper portion, a cylindrical middle portion, and a conical lower portion. The upper portion of the bowl includes a spindle shaft capable of engaging a drive motor. The spindle shaft terminates at its upper end in an outlet port, and the lower portion of the bowl includes a cylindrical extension terminating at its lower end in an inlet/solids discharge port. The hollow central core is disposed about the central axis of the bowl and extends from the spindle shaft to the lower extension of the bowl. The first piston is movably disposed within the bowl and conforms to the inner surface of the bowl. The first piston also surrounds the central core. The second piston is movably disposed within the central core and conforms to the inner surface of the central core. The second piston is capable of extension through the cylindrical extension to discharge the last remaining solids from the bowl, after the first piston has extruded the bulk of the solids from the bowl. In certain embodiments, the lower portion of the separator bowl is removable, and can be attached with a lower portion lock nut. In some embodiments, the separator also includes a bowl liner, a centrate valve assembly, a feed/discharge valve assembly, or a piston position sensing system. The piston position sensing system can be configured to measure the position of the first and/or second pistons within the bowl during operation. Some embodiments of the separator also may include a variable speed vector-type drive motor with speed and angular position sensing. Certain embodiments of the separator also include a piston air supply actuator, which can be driven up or down by ports supplying a drive gas. In some embodiments, the separator is hermetically sealed by seal/sleeve assemblies at the upper and lower ends of the separator bowl, or bowl liner. The seals can be provided with cooling ports and drain ports for a cooling liquid flow to cool the seals and seal assemblies. In certain embodiments, the separator includes structures to maintain stability and dampen oscillation. Such structures include an upper bearing assembly with a spherical or partially spherical mounting, and upper and lower bearing assemblies having anti-rotation pins. In some embodiments, the separator bowl is surrounded by a housing containing a cooling jacket. In some embodiments the housing can be separated into upper and lower portions. In certain embodiments, the separator includes one or more disposable elements such as a disposable bowl liner, a disposable bowl liner/first piston assembly, a disposable separator bowl/bowl liner/first piston assembly, a disposable centrate valve assembly, a disposable second piston assembly, a disposable centrate valve/second piston assembly, or a disposable feed/discharge valve assembly. In some embodiments, all sample contacting surfaces of the separator are disposable. In some embodiments, all sample contacting surfaces of the separator are disposable and the separator is hermetically sealed.

Another aspect of the invention is a method of operating the solids discharge centrifugal separator described in the previous paragraph. The method includes steps (a) through (g) as follows. In step (a), a feed liquid is flowed into the separator bowl through the inlet port. In step (b), the separator bowl is rotated, whereby solid components of the feed liquid accumulate on the inner surface of the bowl. In step (c), the bowl continues to rotate while feed liquid flows into the inlet port, and a clarified centrate liquid flows out through the outlet port. In step (d), the rotation of the bowl is halted and residual liquid is drained from the bowl through the inlet port. In step (e), a pressurized fluid or drive gas is driven into the bowl, whereby the first piston is displaced downward within the bowl and accumulated solids are discharged through the inlet port. In step (f) an actuator for the second piston is driven downward, whereby the second piston moves downward within the central core and causes the final residual solids to be discharged through the inlet port. In certain embodiments, the method also includes step (g), introducing a pressurized fluid or gas through the inlet port into the bowl, whereby the first piston is displaced upward in the bowl. In some embodiments, the separator includes one or more disposable components, and the method includes step (h), replacing one or more of the disposable components prior to repeating step (a). In some embodiments of the method, steps (a) through (g) or (a) through (h) are repeated for two or more cycles of operation with a single type of feed liquid, or with switching over to a different type of feed liquid between cycles. In certain embodiments, a piston position sensing system is used to track the motion of the first and/or second pistons within the bowl during any of steps (a) through (g).

Still another aspect of the invention is a kit for operating or refurbishing a solids discharge centrifugal separator. The kit contains one or more of the following disposable components: a disposable bowl liner, a disposable bowl liner/first piston assembly, a disposable separator bowl/bowl liner/first piston assembly, a disposable centrate valve assembly, a disposable second piston assembly, a disposable centrate valve/second piston assembly, or a disposable feed/discharge valve assembly. The kit may also include instructions for using the disposable component(s) in conjunction with a centrifugal separator Other aspects, features, and advantages of the present invention will be apparent from the Detailed Description of the Invention that follows.

BRIEF DESCRIPTION OF THE DRAWINGS

The invention will be more fully understood by reference to the accompanying drawings of which:

FIGS. 9A, 9B, and 9C are section views of an embodiment of a centrifugal separator in accordance with the invention of which: FIG. 9A shows the separator in a large feed/discharge valve embodiment; FIG. 9B shows a magnified view of the upper hermetic seal area; and FIG. 9C shows the lower portion of a small feed/discharge valve embodiment;

DETAILED DESCRIPTION OF THE INVENTION

Figure 1:
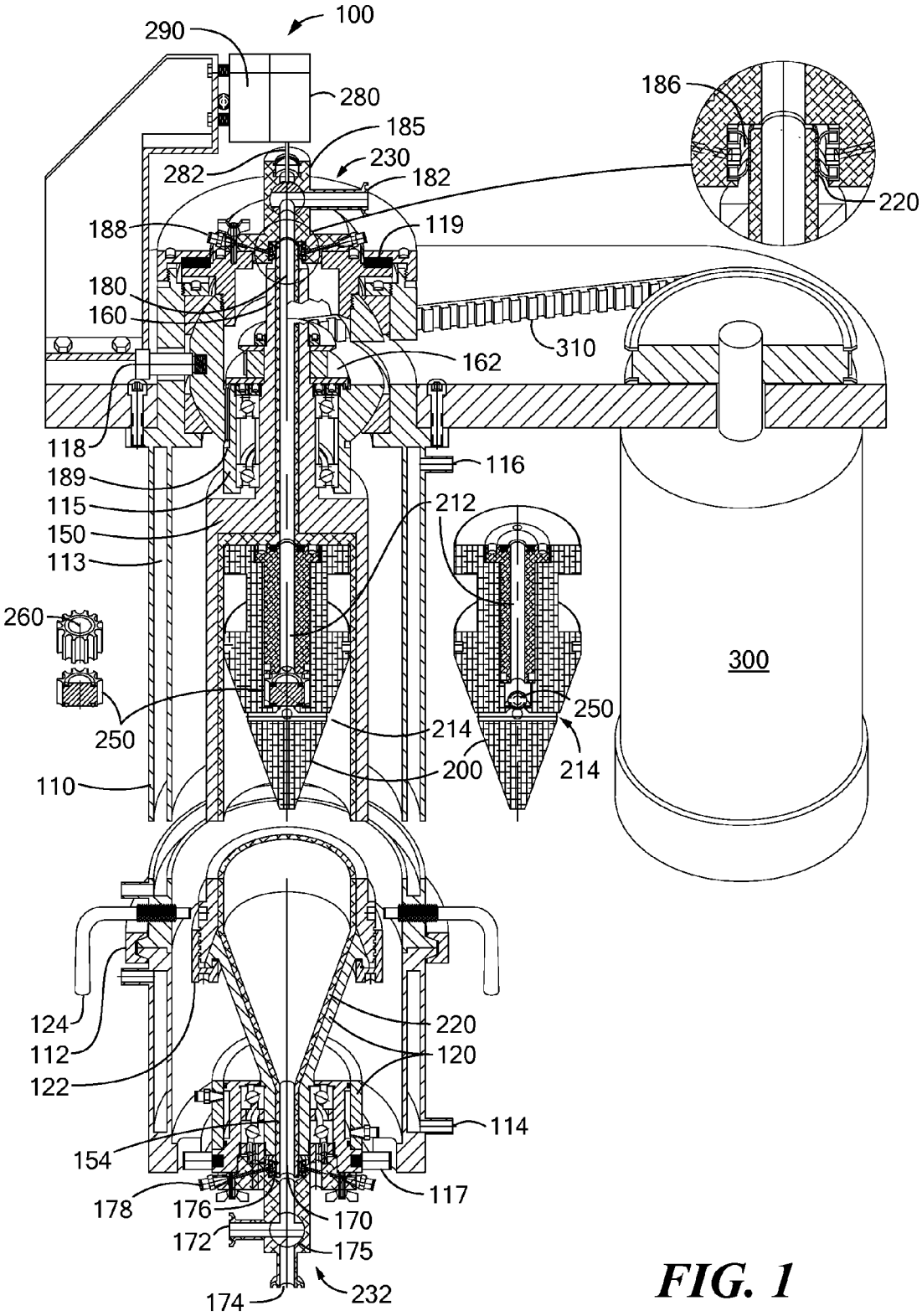
FIG. 1 is a section view of an embodiment of a centrifugal separator in accordance with the invention.

FIG. 1 shows an embodiment of a centrifugal separator according to the invention in vertical section, with a middle section removed. Separator 100 includes separator bowl 150, separator housing 110, and variable speed drive motor 300.

The housing has upper, middle, and lower portions. The middle portion of the separator housing encloses separator bowl 150. In the embodiment shown in FIG. 1 this portion of the housing is temperature controlled by fluid jacket 113 for flowing a controlled temperature fluid, such as water, in through cooling inlet port 114 in the lower portion of the housing and out through cooling outlet port 116 near the top of the middle portion of the housing. Depending on the application the fluid jacket of the housing can be used either to cool or warm the centrifuge interior, and therefore the sample during separation. In separations of sensitive materials such as cell suspensions it is typical to cool the centrifuge using cooling water, for example to a temperature such as 4° C., in order to preserve the structure and function of biological materials such as cells, proteins, or nucleic acids.

The upper portion of the housing contains upper bearing assembly 115 that engages spindle shaft 160 which extends upwardly from the separator bowl. In this embodiment, the bearing assembly 115 includes a semi-spherical upper portion, a short cylindrical middle portion, and a lower semi-hemispherical portion. Optionally, the semi-spherical portions can rest against mating surfaces of one or more seats. An exemplary semi-spherical portion that can be employed in a separator of the invention has been described by U.S. Pat. No. 6,986,734, which is hereby incorporated by reference. The lower portion of the housing includes feed cone and lower bearing assembly 120. The feed cone serves as the lower portion of the bowl, and attaches to the upper portion of the bowl by means of feed cone lock nut 122, which attaches to a thread at the bottom of the cylindrical bowl portion. The lower bearing assembly is integral with lower bowl extension 154 that extends downward from the feed cone. Bowl lock handles 124 are used to secure the bowl during attachment or removal of the feed cone and lower bearing assembly. The lower portion of the housing can be opened by removing lower housing clamp ring 112 for accessing the feed cone and bowl assembly. Other features of the upper and lower housing portions are the lower (117) and upper (118) anti-rotation pins and rubber oscillation restraint ring 119.

Separator bowl 150 has a cylindrical upper portion and a conical lower portion. The lower portion of the bowl includes inlet port 170 at the bottom of the bowl, through which feed liquid is pumped during the feed mode of operation. Rotation of the bowl causes the feed liquid to rise up the inner surface of the conical lower end of the bowl and move radially outward. Solids then separate from the feed liquid and accumulate along the inner surface of the bowl, for example, as a cake. Spindle shaft 160 engages drive belt 310 through drive pulley 162. Outlet port 180 at the top of the spindle shaft allows centrate to exit the bowl. By positioning the inlet and outlet ports at the bottom and top of the bowl, respectively, the bowl can be filled gently and completely with feed liquid from bottom to top of the bowl, leaving no air, so as to avoid or minimize the formation of bubbles or foam that could harm sample components, e.g., through surface tension effects and shear forces that result with other designs.

Piston 200 is disposed within the bowl liner 220. The piston features an upper portion that conforms to the upper portion of the bowl liner and a lower portion that conforms to the lower portion of the bowl liner. In the embodiment shown in FIG. 1 the upper portion of the piston is cylindrical, and the lower portion is conical in form. The piston is capable of moving up and down along the central axis of the bowl. During the feed mode of operation the piston is raised to the top of the bowl, and during the solids discharge mode of operation the piston is gradually lowered in the bowl to displace the accumulated solids from the inner wall of the bowl liner and out through the inlet port at the bottom of the bowl. In the embodiment depicted in FIG. 1, the lower end of the bowl liner and the lower portion of the piston have closely complementary shapes, the lower surface of the piston fitting snugly within the bottom inner surface of the bowl liner, to achieve maximum discharge of solids in a single cycle of operation.

The piston contains a fluid pathway for transport of fluid, such as feed liquid, centrate liquid, or a drive fluid (an inert liquid or gas) through the piston. Disposed within the piston, and situated within the fluid pathway, is shuttle valve 250 that regulates fluid flow through the pathway in response to the pressure across the valve. Two alternative designs for the shuttle valve are depicted. A close-up view of a cylindrical or cog-shaped shuttle valve 250 is shown to the left of the separator, having a mirrored surface 260 at the top. An alternative ball-shaped shuttle valve 250 is depicted to the right of the separator; the ball has a mirrored surface. Seals can be added as appropriate to the piston cavity and/or to the shuttle valve to promote efficient sealing of the valve at its upper and lower limits of travel. The fluid pathway has two parts: a first pathway 212 opening at the top of the piston, extending along the central axis of the piston and ending at the upper side of the shuttle valve; and a second pathway 214 that communicates with the lower side of the shuttle valve and extends a passage radially outward, providing an opening in the lower, conical portion of the piston approximately at the middle thereof. Note that the height of the second pathway along the piston axis is selected such that the pathway openings in the piston lower portion are at an appropriate diameter to avoid taking in accumulated solids from the wall of the bowl liner, which might clog the fluid pathway. When pressure is applied in the first pathway, such as during the solids discharge cycle, the shuttle valve prevents flow from the first pathway down through the second pathway; in the absence of applied pressure in the first pathway, the shuttle valve remains open and allows fluid flow through the piston fluid pathway. Similarly, when pressure in the second pathway exceeds the pressure in the first pathway by another threshold amount, such as when raising the piston after solids discharge, the shuttle valve prevents flow from the second pathway up through the first pathway.

The separator bowl is equipped with a disposable bowl liner 220 that can be replaced after each operation or between operations involving different samples. This can reduce or eliminate the need for clean-in-place and sterilize-in-place procedures, as a clean, sterilized disposable bowl liner can be installed when desired. In embodiments such as the one shown in FIG. 1, the piston 200 can be provided as a disposable, e.g., plastic, piston pre-sealed within the bowl liner as a single replaceable assembly. Replacement is carried out by removing the feed cone nut 122, detaching the feed cone and lower bearing assembly 120, replacing the bowl liner with enclosed piston, and then reattaching the feed cone and lower bearing assembly and tightening the feed cone lock nut.

Upper valve and seal assembly 230 and lower valve and seal assembly 232 are attached to the upper and lower ends of the bowl assembly, at the outlet and inlet ports, respectively. These assemblies mediate the switching of fluid pathways for filling and draining the bowl. They also contain hermetic seals that prevent materials from entering or leaving the bowl interior, thereby ensuring the sterility and purity of bowl contents and protecting the external environment from contamination by bowl contents. Lip seals (176, 186) embedded within the lower and upper valve and seal assemblies, as shown in FIG. 1, provide an appropriate sealing mechanism between the valve assembly body and both lower bowl extension 154 and spindle shaft 160. As this type of sealing mechanism is subject to frictional heating, cooling ports (178, 188) are provided within the lower and upper valve and seal assemblies for the flow of cooling liquid, e.g., water. A seal leakage drain port 189 is also provided to drain away any cooling liquid leaks from the upper lip seal.

The lower valve and seal assembly contains a feed port 172 and a solids discharge port 174, switchable via a three-way ball valve 175 to connect either port to inlet port 170. The upper valve and seal assembly contains a centrate port 182 and an optical port 184. A three-way ball valve 185 switches access from these ports to outlet port 180.

The separator shown in FIG. 1 is fitted with a piston position sensing optical system for automation and increased precision of solids discharge cycles. Laser 280 is mounted to the upper portion of the separator housing such that laser beam 282 can be directed through optical window 164 at the top of upper valve and seal assembly 230. The laser beam is projected through optical port 184, through an open pathway in ball valve 185, and down through spindle shaft 160, and down through first fluid path 212 in piston 200 to be reflected off the surface of mirror 260 mounted on shuttle valve 250. The beam returns back up the same optical pathway and enters signal processing unit 290, where the light is analyzed by a signal processor to produce an output signal that is a measure of the position of the piston within the bowl. The signal processing unit can also contain electronic components such as one or more microprocessors, memory chips, a display, and input devices such as buttons or a keyboard so that operation cycle parameters and settings can be input by an operator or actual operation cycle parameter values can be read by an operator or stored for later retrieval. Input and/or output connections can also be supplied so that input and output of operation parameters, calculations for signal processing, and data storage can be performed by a device such as a computer connected to the separator via the signal processing unit.

Figure 2:
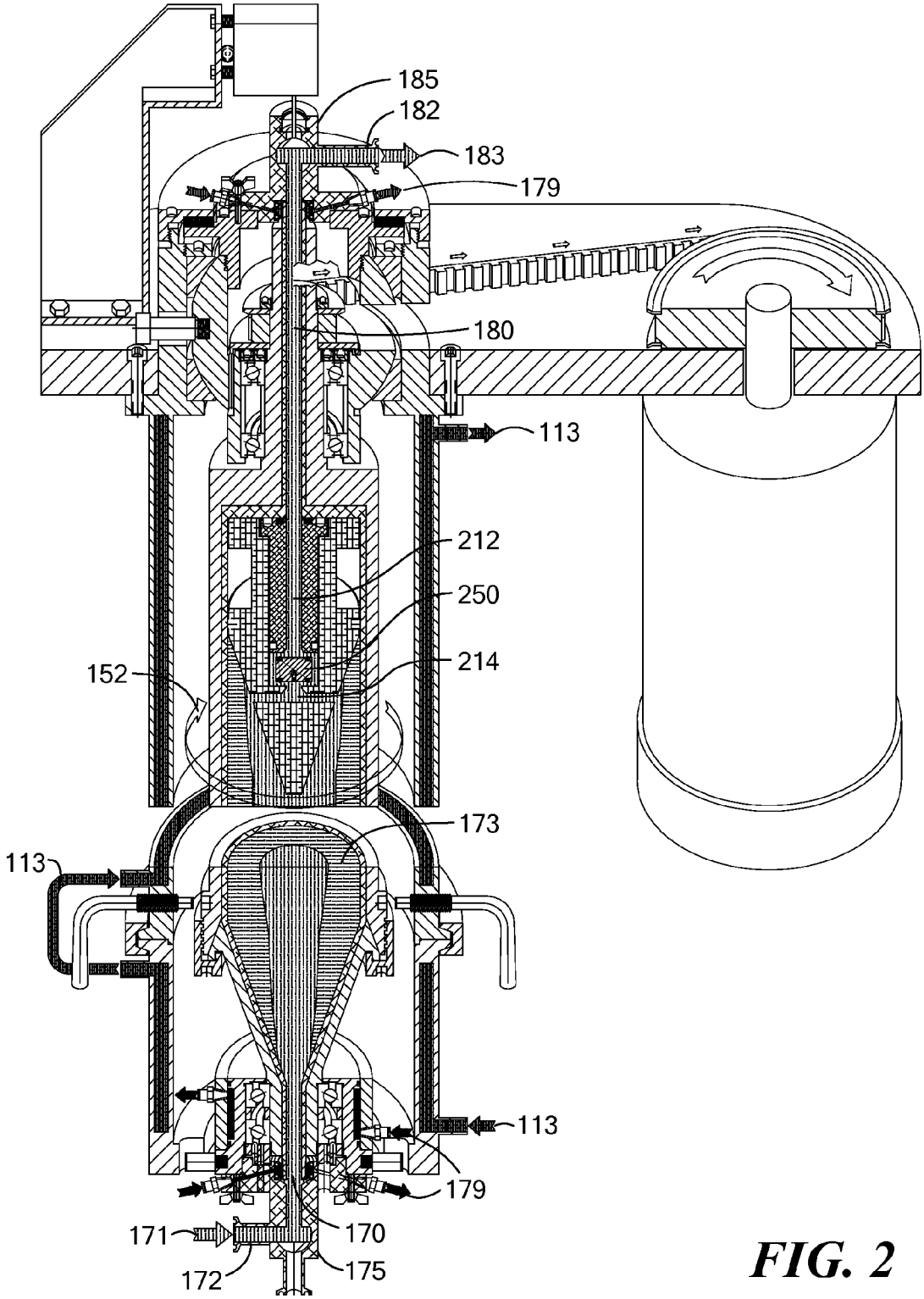
FIG. 2 is a section view of the separator in FIG. 1 operating in a feed mode.

FIG. 2 depicts the centrifuge of FIG. 1 in a feed mode of operation. The lower and middle portions of the separator housing are cooled by the flow of cooling liquid 113. Lower and upper lip seals, as well as the lower bearing assembly, are cooled by coolant flow 179. Rotation (152) of the separator bowl is caused by the drive motor at a speed sufficient to achieve an appropriate level of centrifugal force within the bowl as required for the desired separation. The lower three-way ball valve 175 is set to open a pathway from feed liquid port 172 to inlet port 170. The upper three-way ball valve 185 is set to open a pathway from centrate port 183 to outlet port 180. Feed liquid 171 is pumped into the bowl from below. As feed liquid enters the bowl cavity, solids are deposited onto the inner wall of the bowl liner, and clarified centrate fluid accumulates around the bowl's central axis. The centrate liquid flows into the second fluid pathway 214 of the piston. The rate of flow is sufficient to cause shuttle valve 250 to open, allowing the flow of centrate liquid 183 up through the piston and out through centrate port 182. However, the rate of flow is not so high as to cause the shuttle valve to seal at its upper surface, which would block flow through first fluid pathway 212. The feed mode can continue until sufficient solids have accumulated inside the bowl to justify or require draining the bowl and running a solids discharge cycle.

Figure 3:
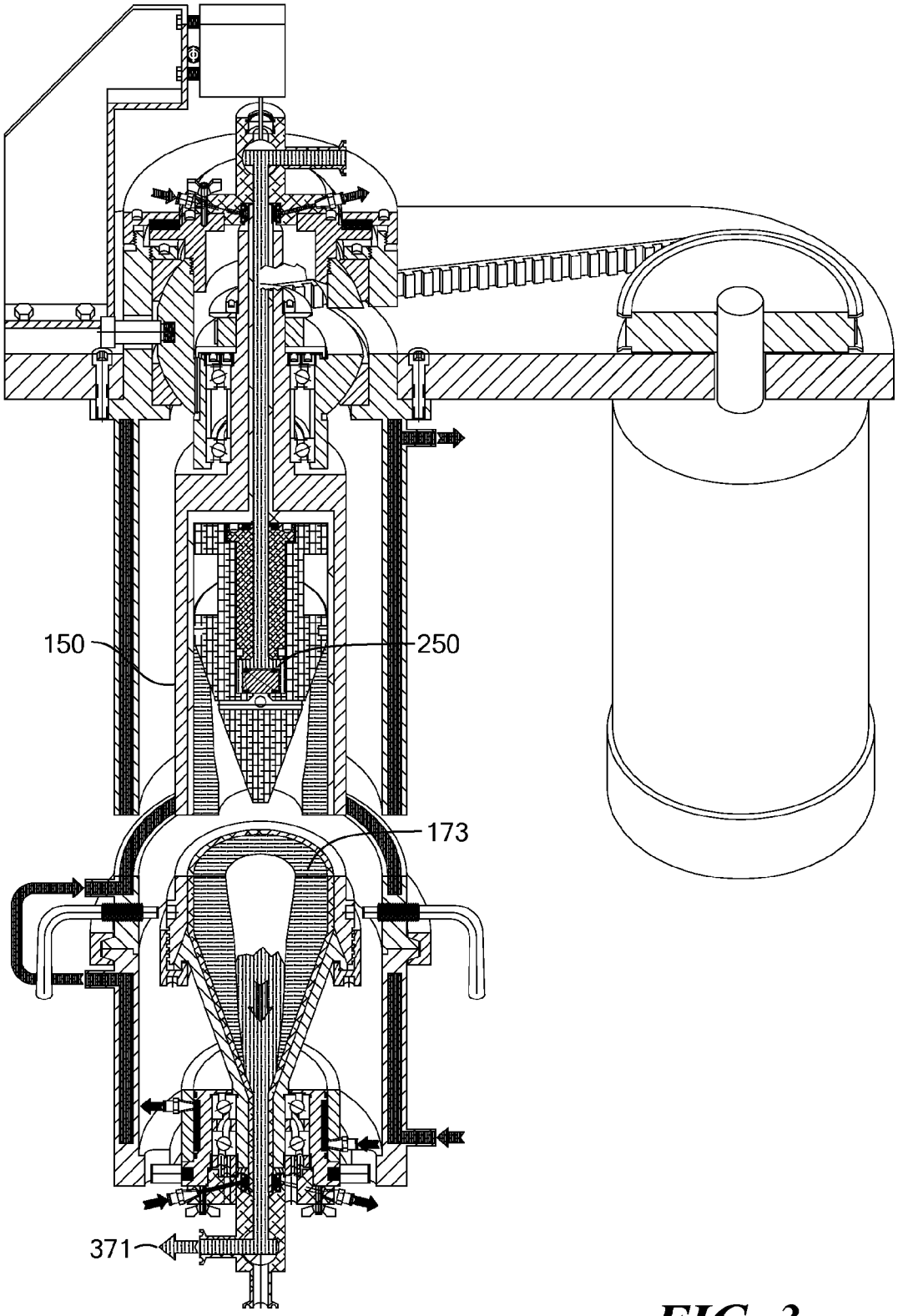
FIG. 3 is a section view of the separator in FIG. 1 operating in a drain mode.

FIG. 3 depicts the centrifuge of FIG. 1 in a drain mode. The drive motor and bowl 150 have braked to a stop. Residual feed liquid 371 is drained or pumped back through the feed liquid port, and can be collected or recycled back to a feed liquid holding tank. Due to the lack of centrate liquid pressure from below, shuttle valve 250 closes to prevent backflow of centrate through the first fluid pathway of the piston and into the bowl chamber. The collected solids 173 remain adhered to the bowl liner.

Figure 4:
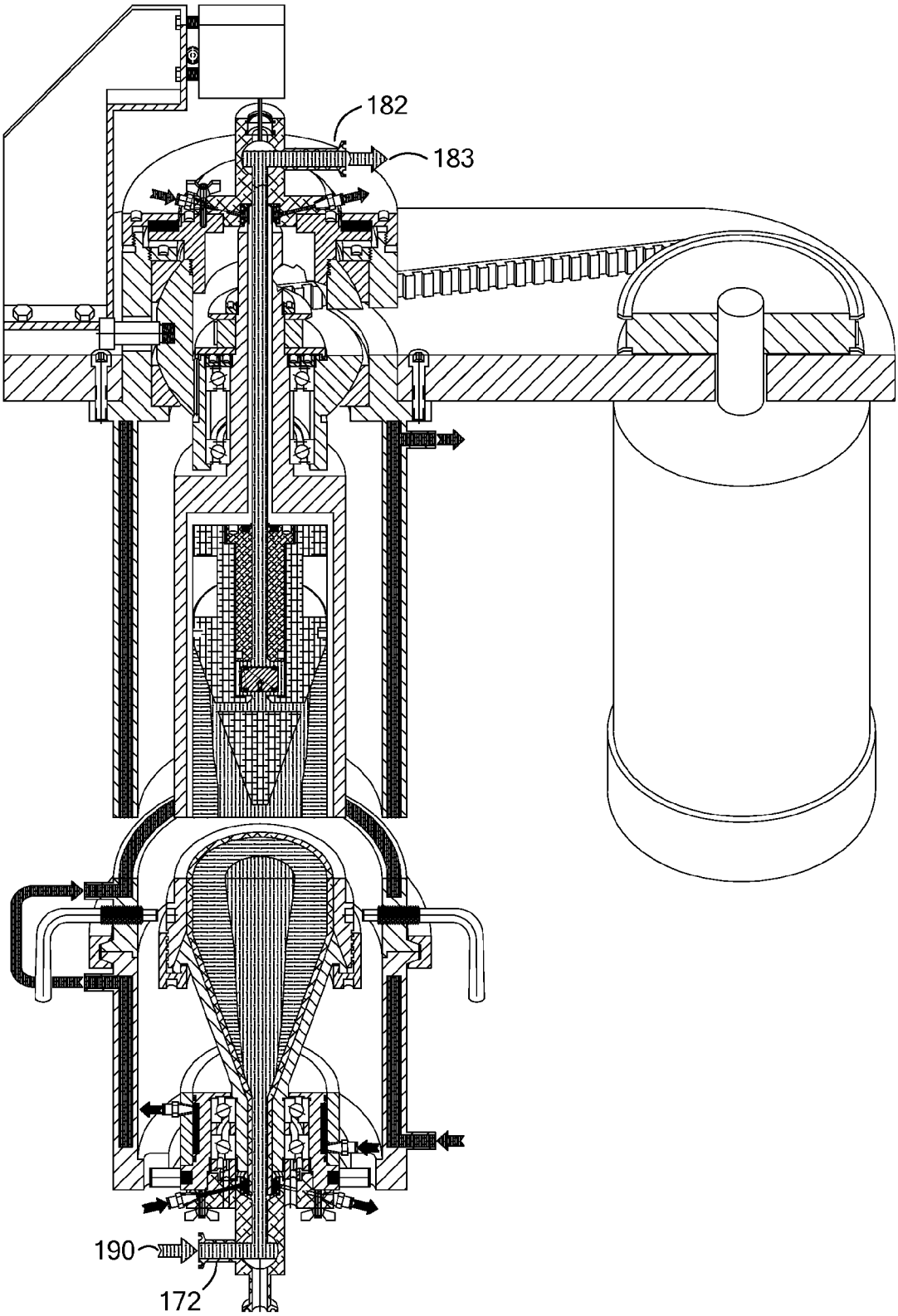
FIG. 4 is a section view of the separator in FIG. 1 operating in a centrate purge mode.

FIG. 4 shows the centrifuge of FIG. 1 just after draining as shown in FIG. 3. In FIG. 4, the centrifuge is shown in a centrate purge mode. An inert drive gas 190 (e.g., air, nitrogen, or argon) flows through the feed liquid port 172, into the bowl, and up through the piston. The flow rate of the gas is sufficient to open the shuttle valve from the second fluid pathway, but not sufficient to close the shuttle valve to the first fluid pathway. Centrate liquid 183 remaining from the drain cycle is driven out the centrate port 182 by the drive gas.

Figure 5:
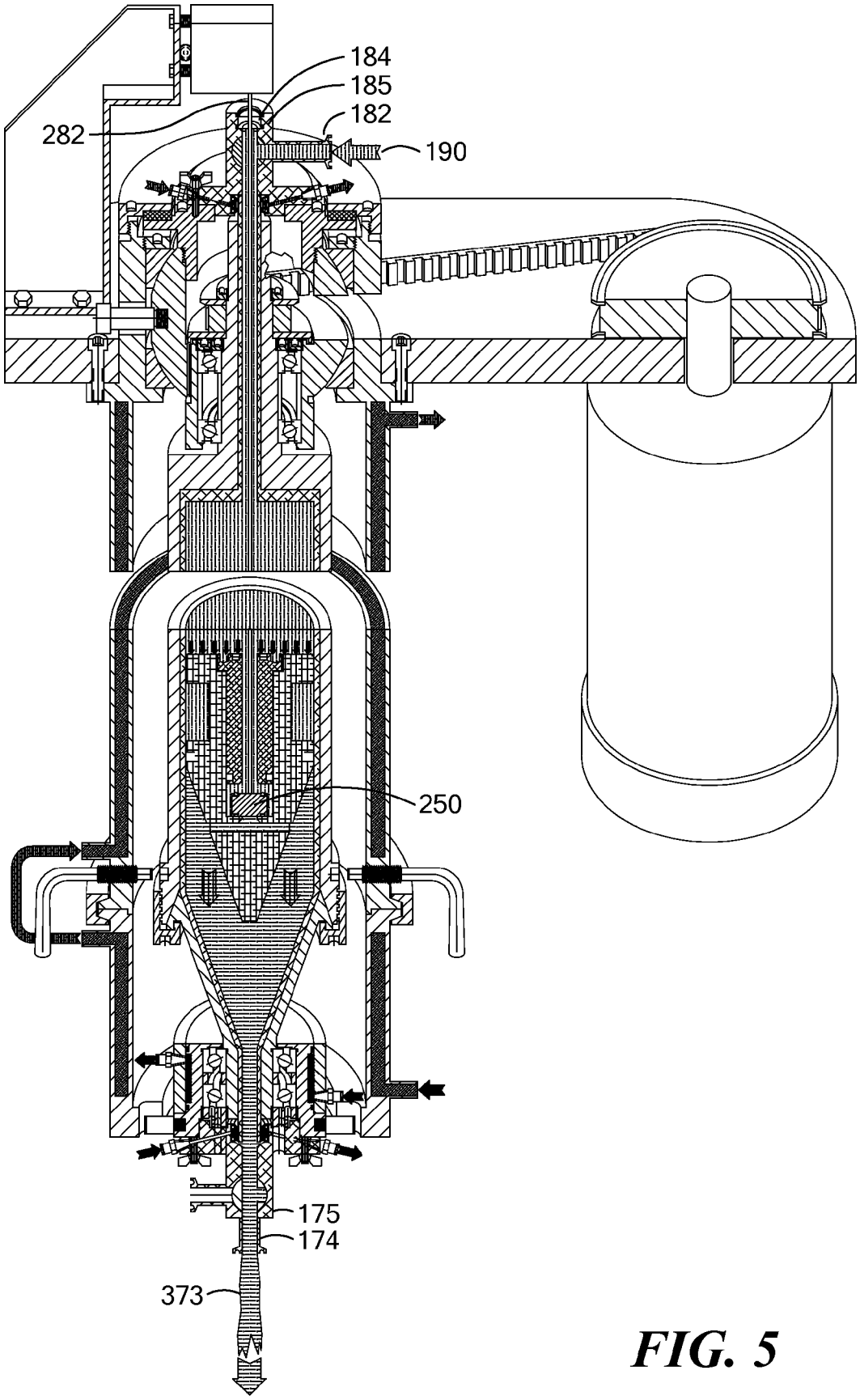
FIG. 5 is a section view of the separator in FIG. 1 operating in a solids discharge mode.

FIG. 5 depicts the centrifugal separator of FIG. 1 in a solids discharge mode. Lower three-way ball valve 175 has been switched to provide a pathway from the inlet port to solids discharge port 174. Upper three-way ball valve 185 has been switched to provide a pathway from the outlet port to both centrate port 182 and optical port 184, which contains a window for transmitting laser beam 282 in both directions. Drive gas 190 is introduced through centrate port 182, causing the shuttle valve 250 to close at its lower surface, preventing flow of the gas through the second fluid pathway in the piston. The pressure of the drive gas causes the piston to move downward in the bowl, displacing the accumulated solids from the inner face of the bowl liner and out through the solids discharge valve for collection. The motion of the piston is tracked by the laser beam, which is reflected off the mirror on the shuttle valve back into a signal processing unit attached to the separator housing. Because the solids consistency may vary, the time required to complete solids discharge may also vary. The use of an automated piston position sensing system allows the piston position within the bowl to be known, so that the cycle can be terminated by stopping the flow of drive gas at the appropriate time, e.g., when the piston has reached the bottom of the bowl.

Figure 6:
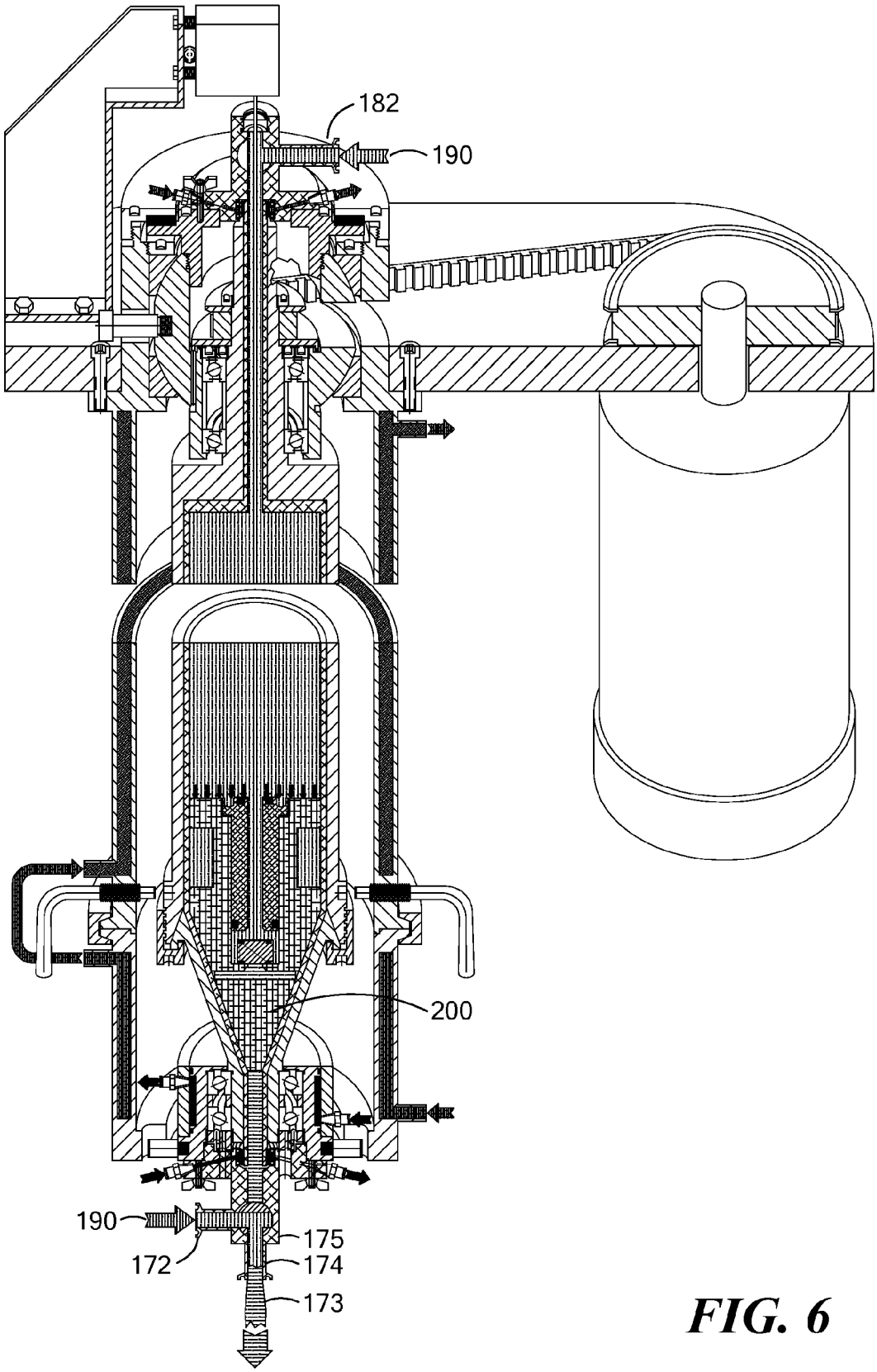
FIG. 6 is a section view of the separator in FIG. 1 operating in a solids purge mode.

FIG. 6 shows the separator of FIG. 1 with the piston at full stroke, at the bottom of the bowl. Pressure from drive gas 190 is maintained at the centrate port 182, holding the piston in its lowest position, while the lower three-way valve 175 is switched to provide a pathway from the feed liquid port 172 to the solids discharge port 174, allowing solids (373) trapped in the valve to be purged by drive gas applied at the feed liquid port.

Figure 7:
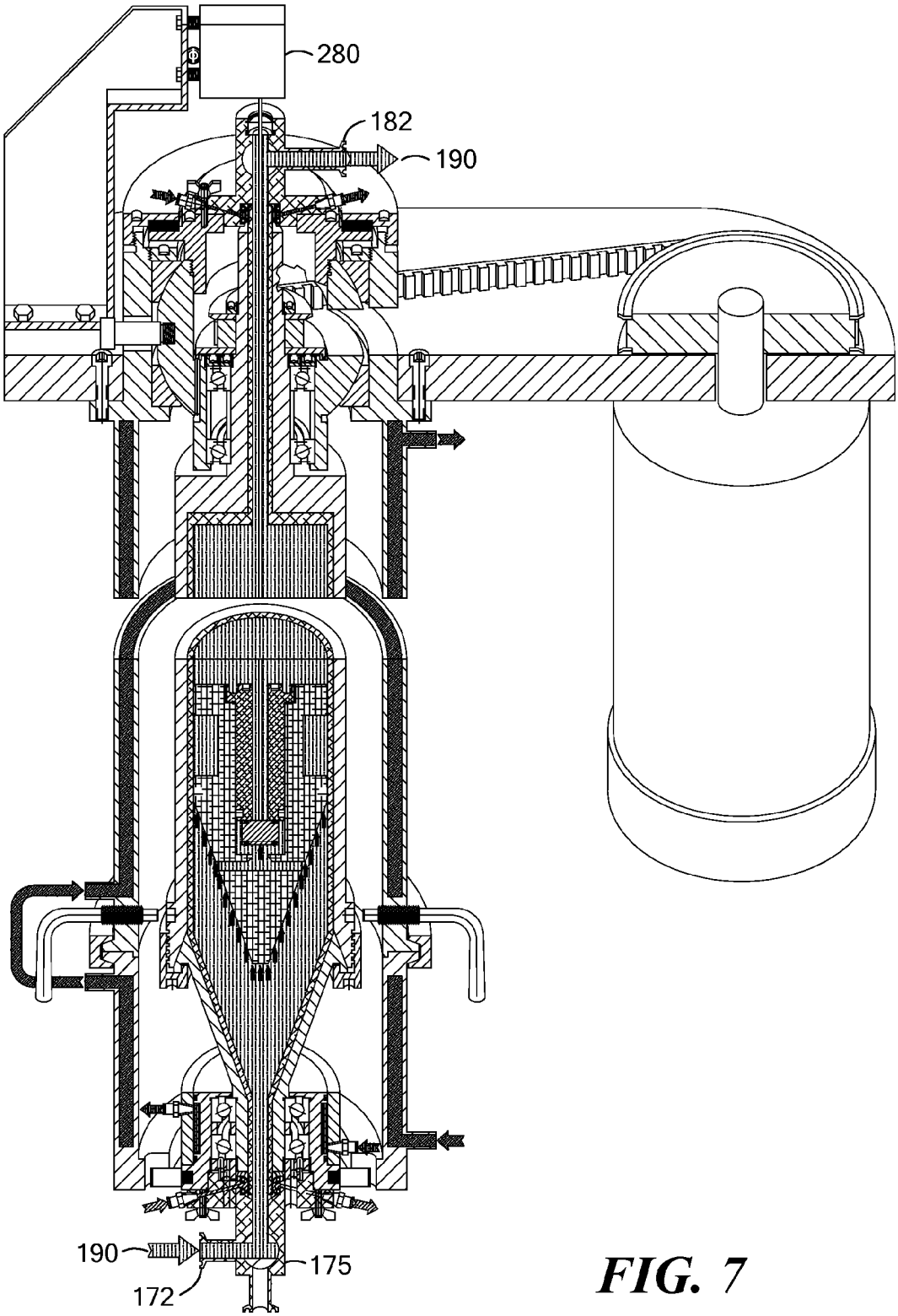
FIG. 7 is a section view of the separator in FIG. 1 illustrating return of the piston to its uppermost position after solids discharge.

In FIG. 7 the separator of FIG. 1 is shown in a piston retraction mode. Following a solids discharge cycle, the piston is returned to its uppermost position prior to beginning another feed cycle. Lower three-way valve 175 has been switched to connect only the feed liquid port 172 to the inlet port. Drive gas 190 is applied through feed liquid port 172 to urge the piston upward. The gas pressure is sufficient to close the shuttle valve against the first fluid pathway in the piston. The supply of drive gas at centrate port 182 has been cut off, but the valve remains open to permit gas to escape as the piston rises. Laser 280 is used to track the movement of the piston, sensing when the piston has reached the top of its stroke.

Figure 8:
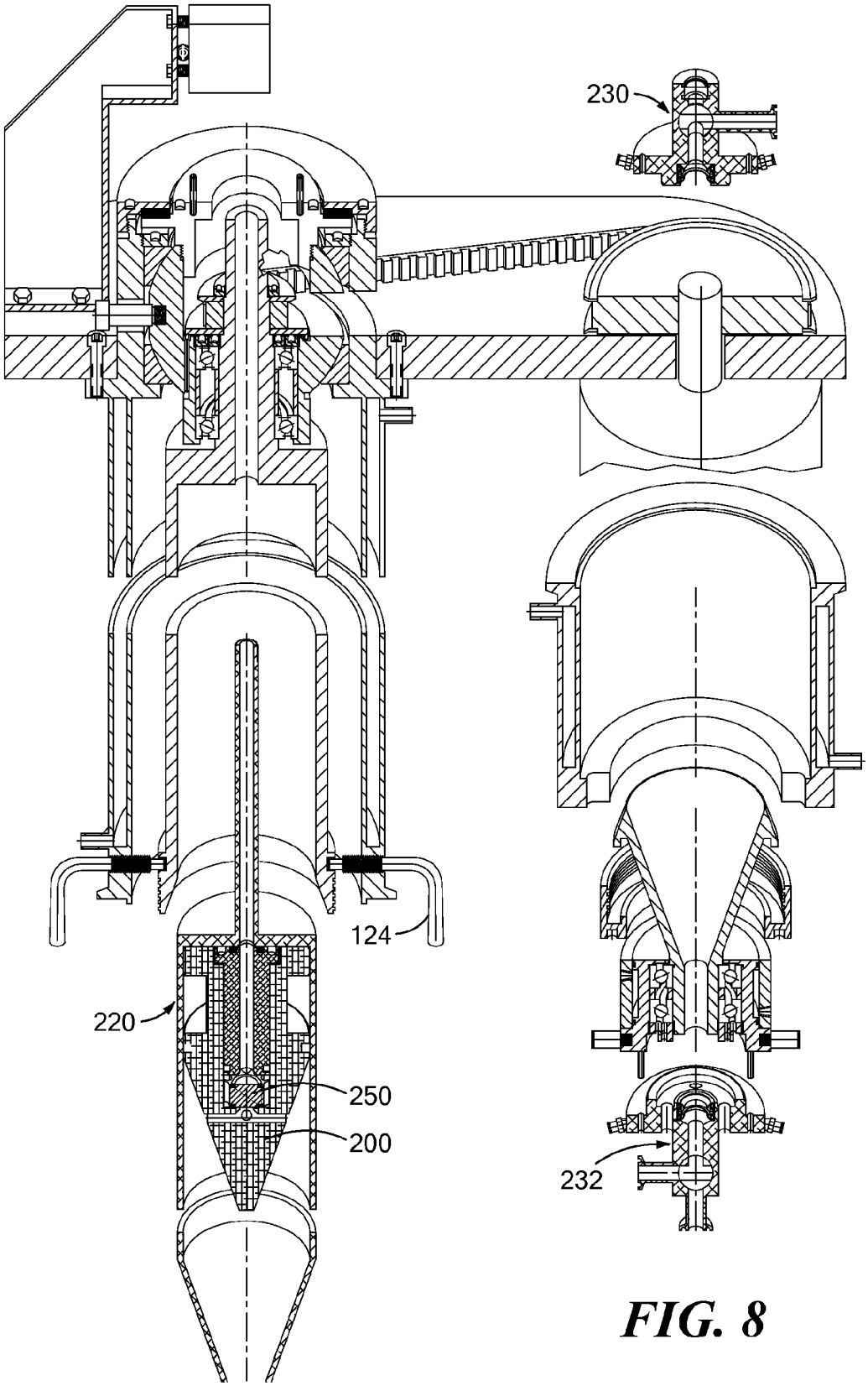
FIG. 8 is a section view of the separator in FIG. 1 following operation, in a disassembled configuration for replacement of disposable components.

FIG. 8 schematically depicts how disposable elements of the separator are removed and replaced. Upper valve and seal assembly 230 and lower valve and seal assembly 232 are removed and discarded. The lower portion of the separator housing is removed, and then the feed cone nut is unscrewed and the feed cone and lower bearing assembly is removed; these components are set aside for reuse. Bowl liner 220 containing piston 200 with shuttle valve 250 are removed and discarded. A new bowl liner assembly containing a new piston and shuttle valve can then be installed in the housing. The feed cone and lower bearing assembly is replaced and retained using the feed cone lock nut. The lower housing portion is replaced, and new upper and lower valve and seal assemblies are installed. The separator is then prepared to separate a new sample.

Figure 9A:
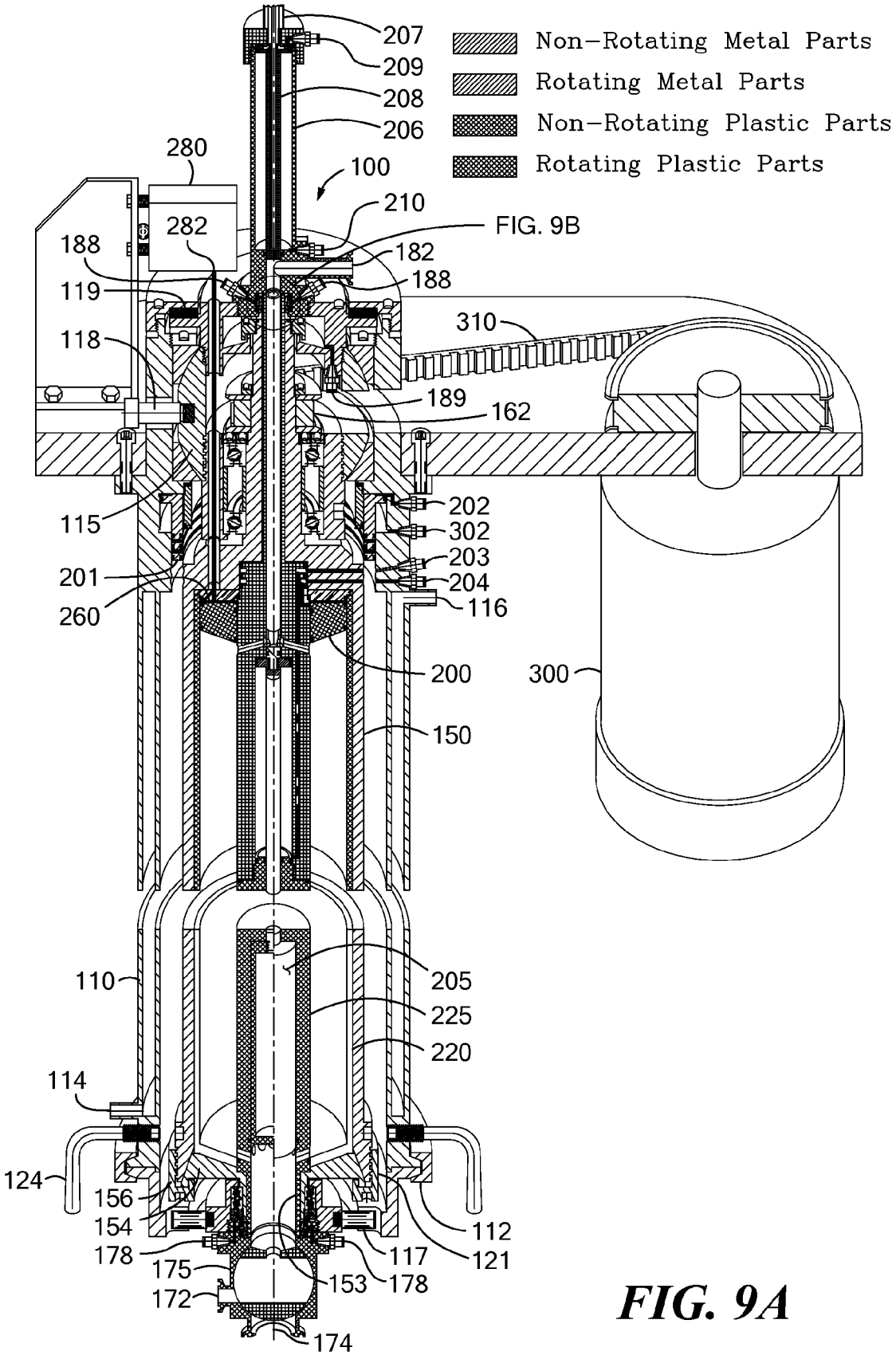
Figure 9B:
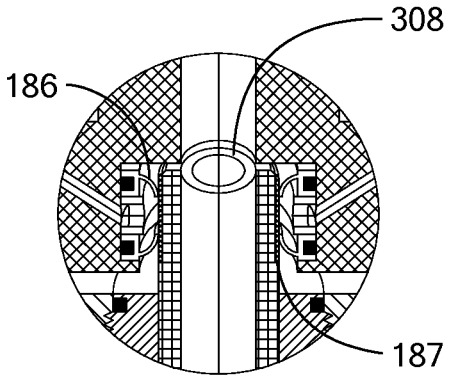
Figure 9C:
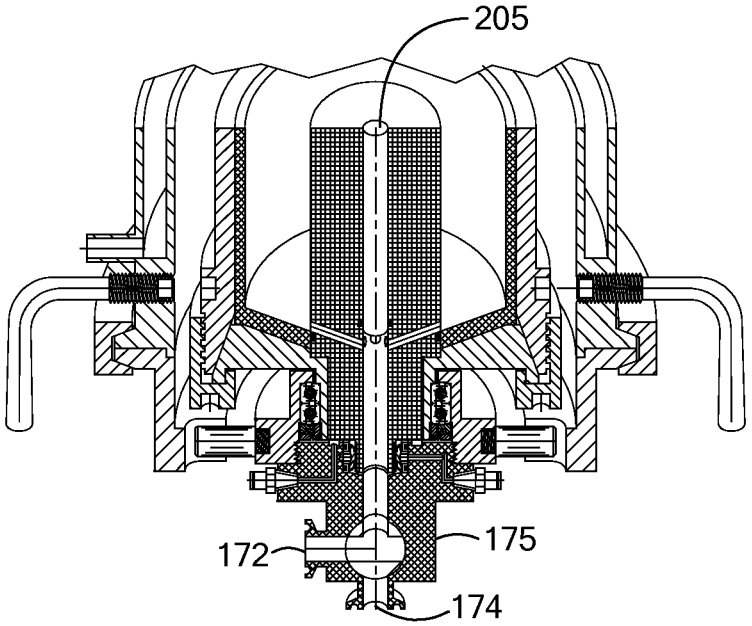

FIGS. 9A, 9B, and 9C show another embodiment of a centrifugal separator according to the invention having dual solids discharge pistons. The separator is shown in vertical section with a middle section removed. Many of the parts are the same as, or similar to, the embodiment depicted in FIG. 1. The differences are discussed below. The dual piston design allows for more complete extraction of solids, and also less cross-contamination between cycles, than a single piston design.

Separator bowl 150 encases bowl liner 220, which is removable from the bowl and preferably disposable. First piston 200, which is responsible for discharging most of the solids accumulated along the inner wall of the bowl liner, is encased by the liner, and the sides of the piston conform to the inner wall of the bowl liner. Aligned with the central vertical axis of the bowl liner is central core 225, which extends from the top to the bottom of the bowl liner. The lower inner surface of the bowl liner preferably conforms to the lower surface of the first piston. The first piston includes a central hole to accommodate the central core, along which the first piston moves within the bowl liner. Inside the central core is second piston 205, which is attached at its top surface to push rod 208, used to drive the second piston downward to expel residual solids during the discharge cycle. The second piston can be configured in different diameters, according to the needs of the separation. For example, FIG. 9A depicts a large second piston design, appropriate for a thicker, more viscous solid paste, while FIG. 9C depicts a small second piston design with smaller piston diameter, suitable for thinner, less viscous solid paste. The large configuration of the second piston preferably has a diameter from about 30 to about 40 mm, and the small configuration preferably has a diameter from about 10 mm to about 30 mm, though other sizes also can be used according to the needs of a particular application. Cylindrical extension 154 extends from the bottom of the bowl liner and forms the pathway for both adding feed liquid to the separator during separation and removing accumulated solids during the solids discharge process.

The upper portion of the bowl liner is preferably extended up through the spindle portion of the bowl, and is fitted into a centrate valve assembly, as depicted in FIG. 9B. The centrate valve assembly can be combined with second piston actuator unit 206 as shown in FIG. 9A, or the centrate valve assembly and second piston actuator can be configured as separate units. The uppermost portion of the upper bowl liner extends from the spindle and fits into the centrate valve assembly, where it meets with centrate valve assembly seals 187. The optional seals provide a hermetically sealed environment within the bowl liner during separator operation. Optionally, the liner extension is fitted with sleeve 187, that contacts the seals. For example, seals can be "Flexlip" all plastic lip seals (Parker, Cleveland, Ohio), and the sleeve can be a CR "Speedi Sleeve®" (SKF Sealing Solutions, Elgin, Ill.). Ports 188 for seal cooling liquid can be included in the centrate valve assembly, as well as a seal leakage drain port 189.

Lower extension 153 of the bowl liner fits into lower bowl extension 154, which in turn is fitted within lower bearing assembly 121. The lower bearing assembly is in turn attached to lower housing clamp ring 112, which secures the bearing assembly and the separator bowl to the lower portion of separator housing 110. The bearing assembly can be stabilized with anti-rotation pins 117. The clamp ring is removable to allow access to the separator bowl and its liner assembly. For removal of lower bowl extension 154 and exchange of the bowl liner assembly, bowl bottom lock nut 156 provides access. In order to extract the lock nut, the separator bowl can be fixed in place using bowl lock handles 124.

Feed/discharge valve assembly 175 is attached to the lower end of lower bearing assembly 121, and includes a three-way valve to allow switching between one pathway providing access to feed liquid and another pathway providing an exit port for solids discharge from the separator. The solids discharge path through the valve has a diameter that just accommodates the second piston, which is extended through the valve to remove the last remaining residual solids from the valve during a final discharge operation. The three-way valve can be, for example, a ball valve. The feed/discharge assembly can be configured in large and small versions, for use with the large and small embodiments of the second piston, as described above. Preferably, the feed/discharge valve assembly is disposable, and preferably made of one or more plastic materials. If the separator is to be hermetically sealed during operation, then the feed/discharge valve can be provided with lip seals, and the lower extension of the bowl liner can be provided with a sleeve to contact the seals, as discussed above for the centrate valve assembly. The valve can be outfitted with ports 178 for seal cooling liquid.

Figure 10:
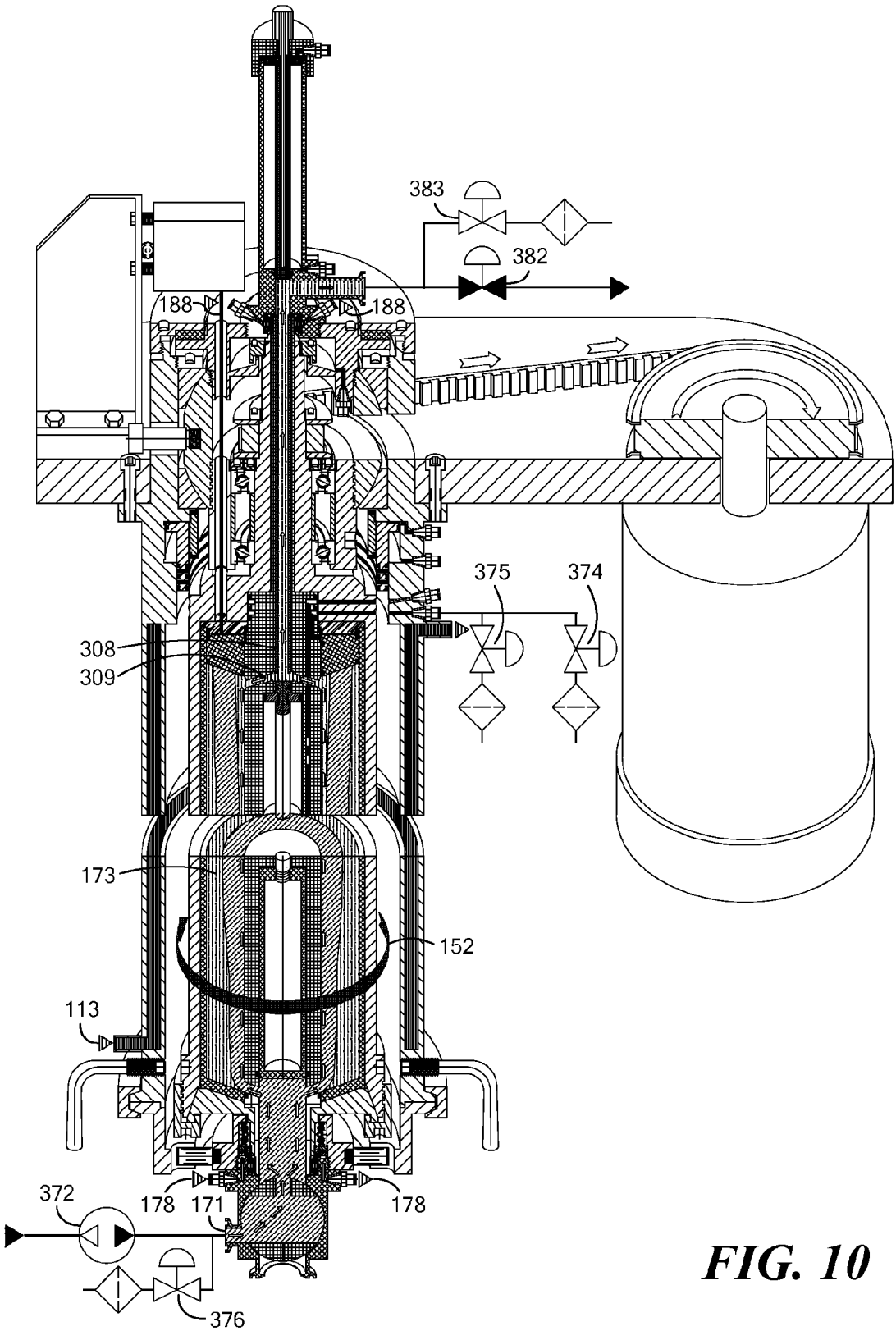
FIG. 10 is a section view of the separator in FIGS. 9A, 9B, and 9C operating in a feed mode.

FIG. 10 shows the separator of FIGS. 9A, 9B, and 9C in a feed and separation mode. The first and second pistons are in their uppermost positions. The bowl is rotated 152 at a speed appropriate for separation. Drive motor 300 is preferably a variable speed vector-type motor with speed and angular position sensing. Preferably, cooling liquid 113 is circulated through the separator housing. Solids 173 accumulate along the inner wall of the bowl liner. The presence of the central core eliminates most of the air space within the bowl, thereby eliminating a source of turbulence that can be detrimental to both the separation and to components of the feed liquid that are being separated. Centrate liquid flows out of the separator bowl through centrate channel 309 in the central core, and out through the open centrate valve 382 under pressure from feed pump 372, while drain valve 383 and feed retract valve 376 remain closed. Piston vent valve 375 and discharge valve 374 also remain closed. Second piston push rod 308 includes one or more openings just above its contact point with the second piston; these openings allow centrate fluid to escape upwards through the hollow push rod 308. Cooling liquid is circulated through seal cooling ports 178 and 188.

Figure 11:
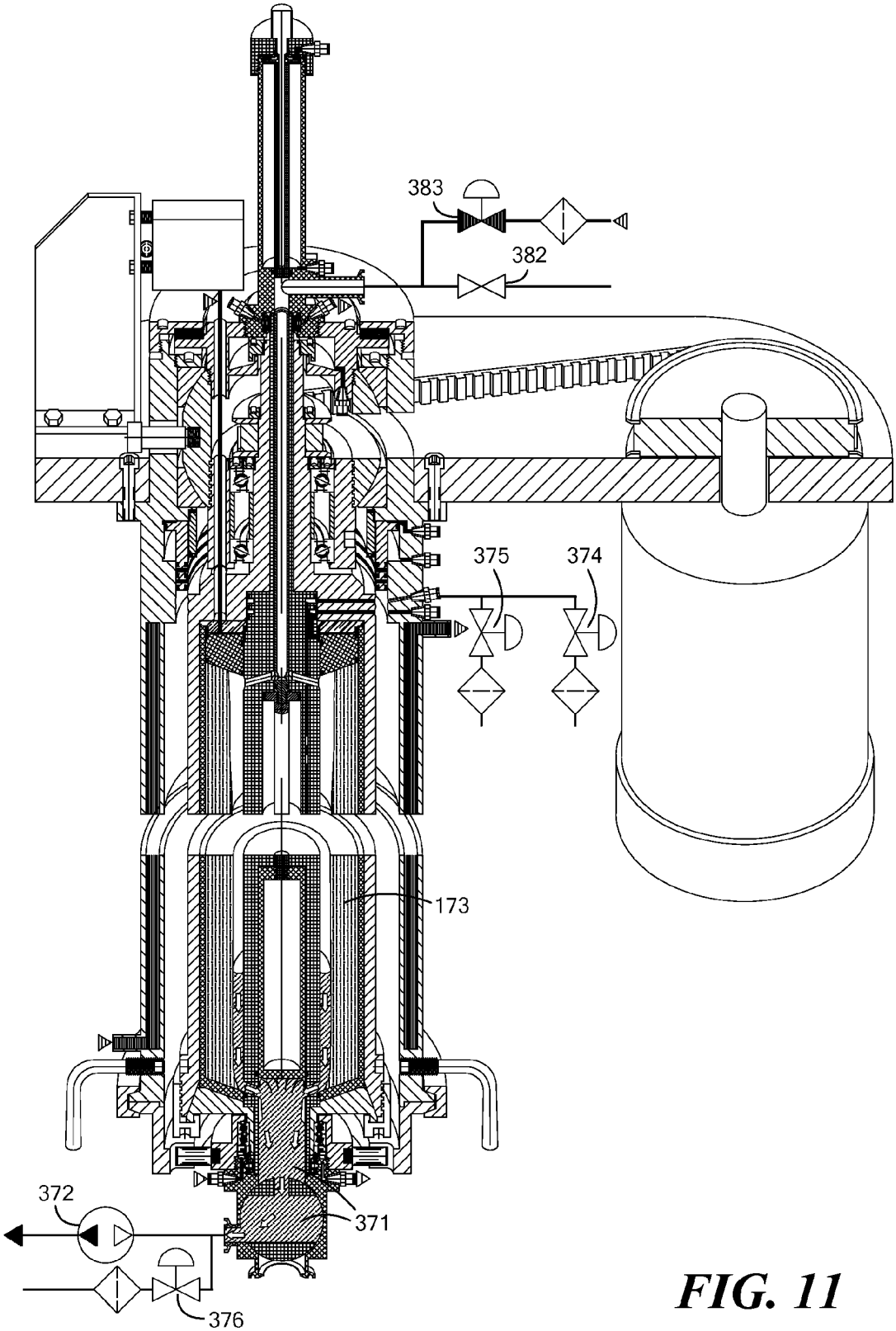
FIG. 11 is a section view of the separator in FIGS. 9A, 9B, and 9C operating in a drain mode.

FIG. 11 shows the separator of FIGS. 9A, 9B, and 9C in a drain mode, following separation. The motor has been ramped to a stop. Reversible feed pump 372 pumps residual feed liquid back into a storage vessel, with drain vent valve 383 in the open position. Valves 382, 375, 374, and 376 are closed.

Figure 12:
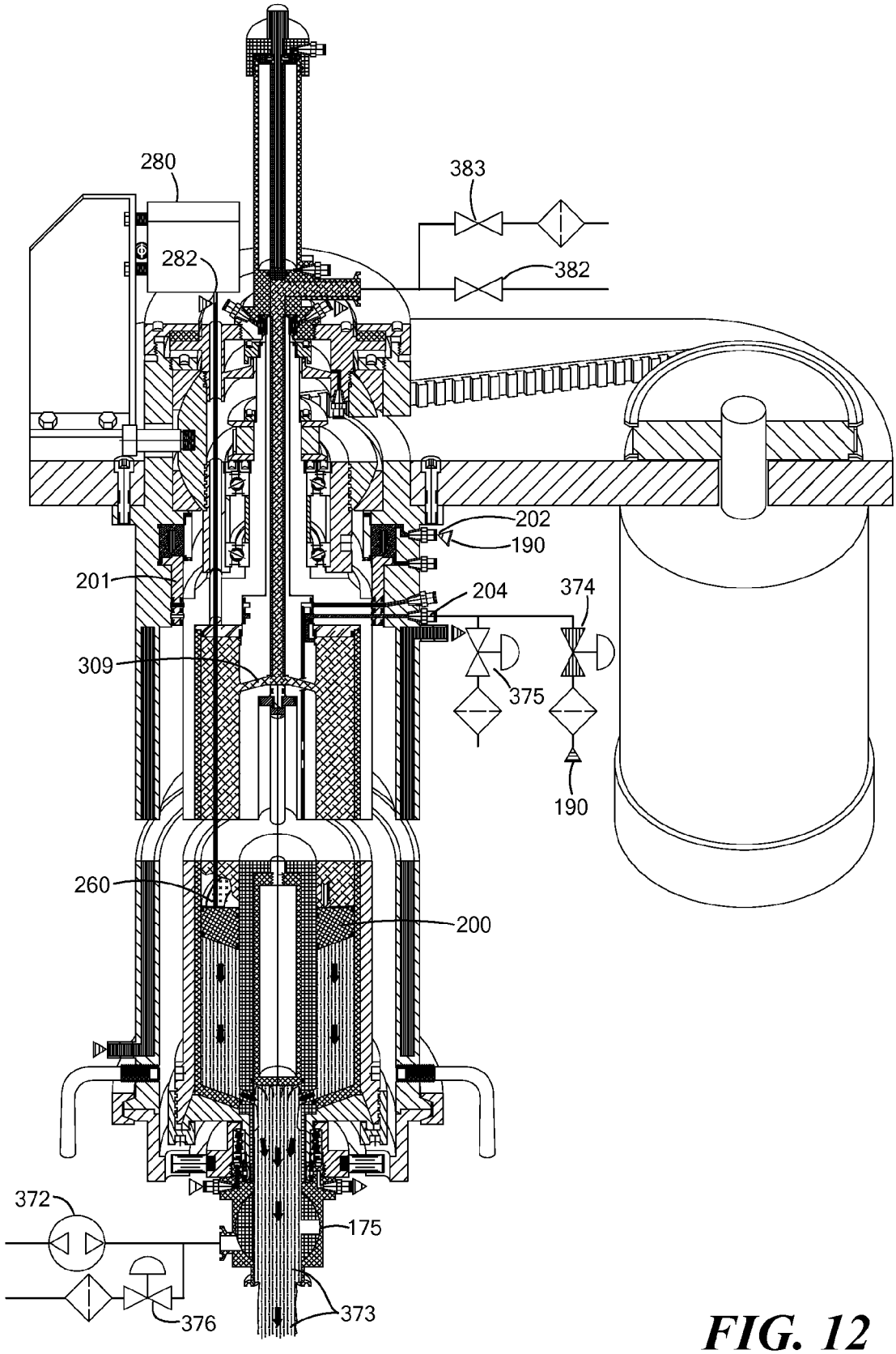
FIG. 12 is a section view of the separator in FIGS. 9A, 9B, and 9C operating in a solids discharge mode.

FIG. 12 shows the separator of FIGS. 9A, 9B, and 9C in an initial solids discharge mode following the drain mode. The drive motor is stopped. Feed/discharge valve 175 is rotated to the discharge position, and accumulated solids 373 are discharged through the discharge port. Feed retract valve 376 is closed, and feed pump 372 is off. Drive gas 190 is applied through solids discharge valve 374. A solids discharge piston air supply isolation actuator 201 is urged downward by drive gas applied to isolation actuator port 202. In this position, the isolation actuator opens a pathway from first piston down port 204 to allow drive gas from the discharge valve to reach the space above first piston 200, thereby urging the piston downward. Valves 375, 376, 382, and 383 remain closed. The position of the first piston within the bowl can be tracked using time-of-flight laser unit 280, which sends laser beam 282 through the upper bearing assembly and a window in the bowl and bowl liner to be reflected off a mirrored surface or reflective tape 260 on the top surface of the first piston.

Figure 13:
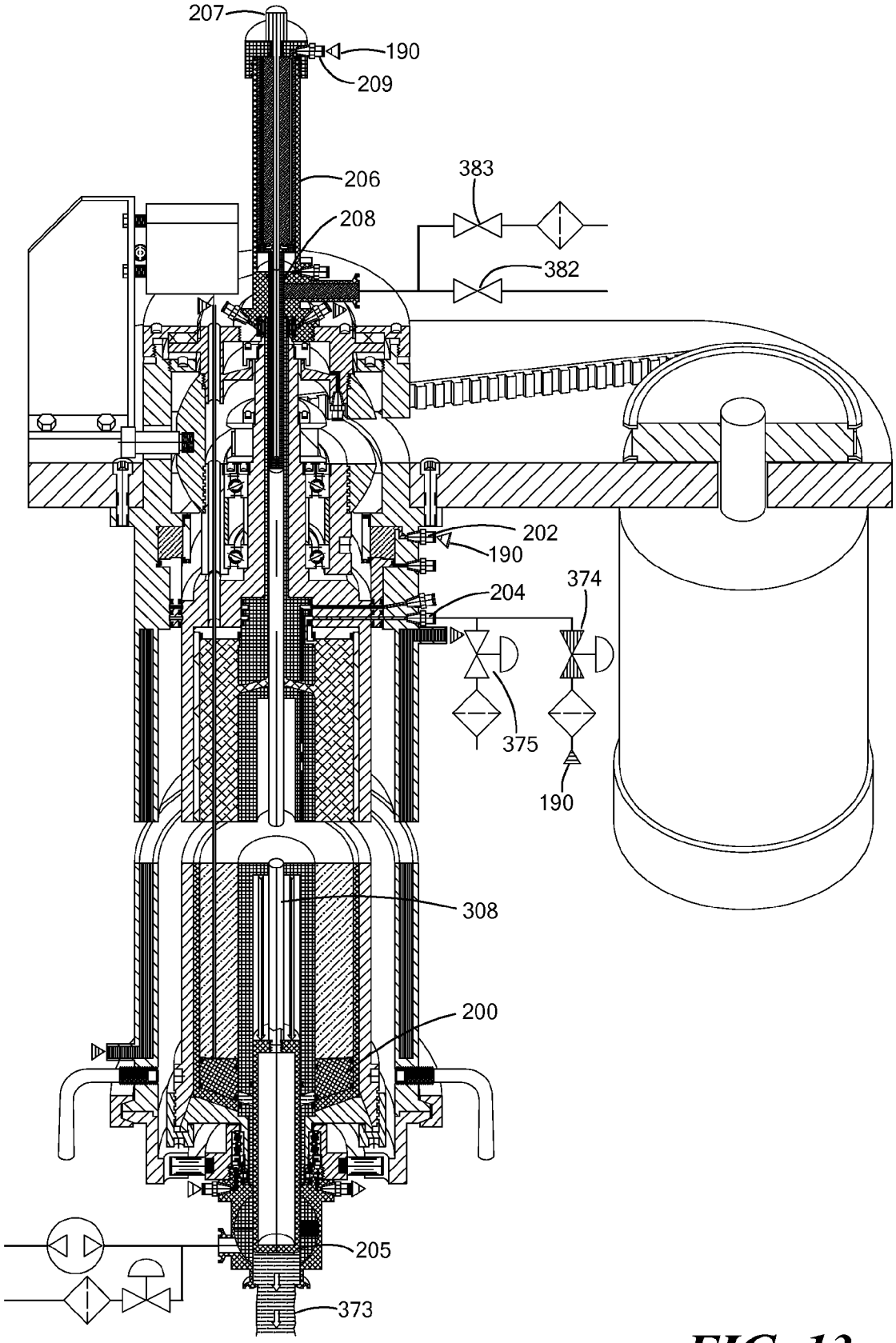
FIG. 13 is a section view of the separator in FIGS. 9A, 9B, and 9C operating in a final solids discharge mode.

FIG. 13 shows the separator of FIGS. 9A, 9B, and 9C in a final discharge mode following the initial discharge mode shown in FIG. 12. The drive motor is stopped. The first piston 200 is lowered all the way to the bottom of the bowl, and second piston 205 is lowered through the feed/discharge valve to remove the last remaining solids 373 from the valve. The second piston is driven downward through the action of hollow push rod 208, which in turn is driven by second piston actuator 206. The actuator is driven by gas applied to second piston down port 209. Second piston actuator drive rod 208 contacts second piston push rod 308. Push rod 308 Discharge valve 374 remains open and the first piston isolation actuator remains in the down position with gas applied at ports 202 and 204, which maintains the first piston in its lowermost position. The position of the second piston within the bowl or discharge valve can be tracked using second piston position sensor 207, which can be, e.g., a magnetic or capacitive position sensor within actuator 206. Remaining valves 376, 375, 382, and 383 are closed.

Figure 14:
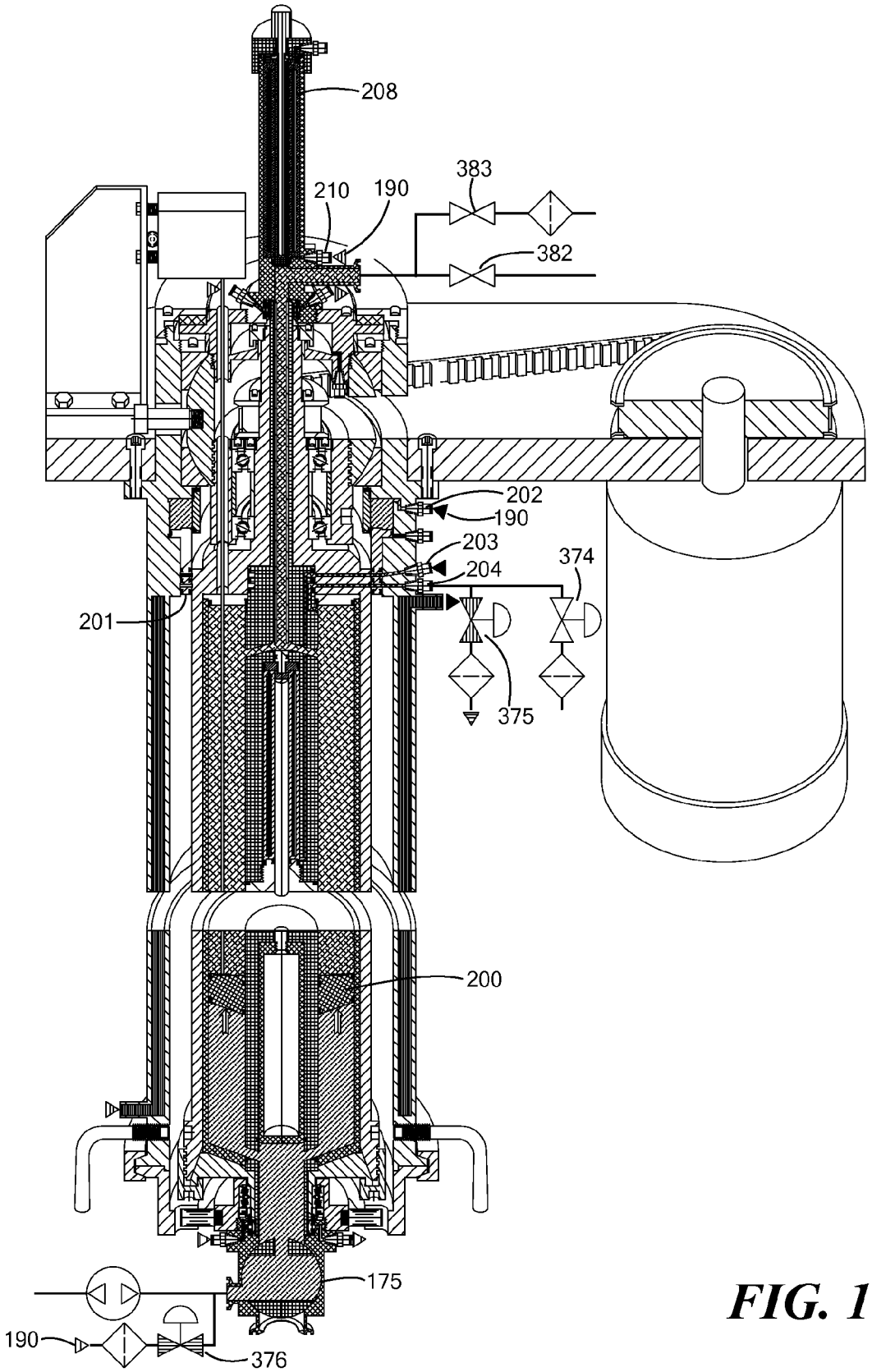
FIG. 14 is a section view of the separator in FIGS. 9A, 9B, and 9C illustrating return of the piston to its uppermost position after solids discharge.

FIG. 14 shows the separator of FIGS. 9A, 9B, and 9C in a piston retract mode following the final discharge mode shown in FIG. 13. The drive motor is stopped. Retract valve 376 is open and in feed position, and drive gas is applied through the feed/discharge valve to raise the first piston. Gas is also applied to piston isolation actuator down port 202 to maintain isolation actuator 201 in the lowered position, which opens a pathway to allow drive gas from port 203 to reach the underside of the second piston. The drive gas drives the second piston upward to its starting position, and the second piston in turn drives push rod 308 upwards as well, to its starting position within the separator bowl spindle. Drive gas is also applied to second piston actuator up port 210 to retract second piston drive rod 208. Piston vent valve 375 is open to allow gas trapped above the first piston to escape through port 204; this is also enabled by the lowered position of the isolation activator, which opens a pathway between port 204 and the space above the first piston. Valves 374, 382, and 383 are closed. The positions of the first and second pistons can be monitored during retraction using their respective position sensing systems. Once the first piston has been fully retracted, the isolation actuator is also retracted to the raised position by applying drive gas to isolation activator up port 302.

Figure 15:
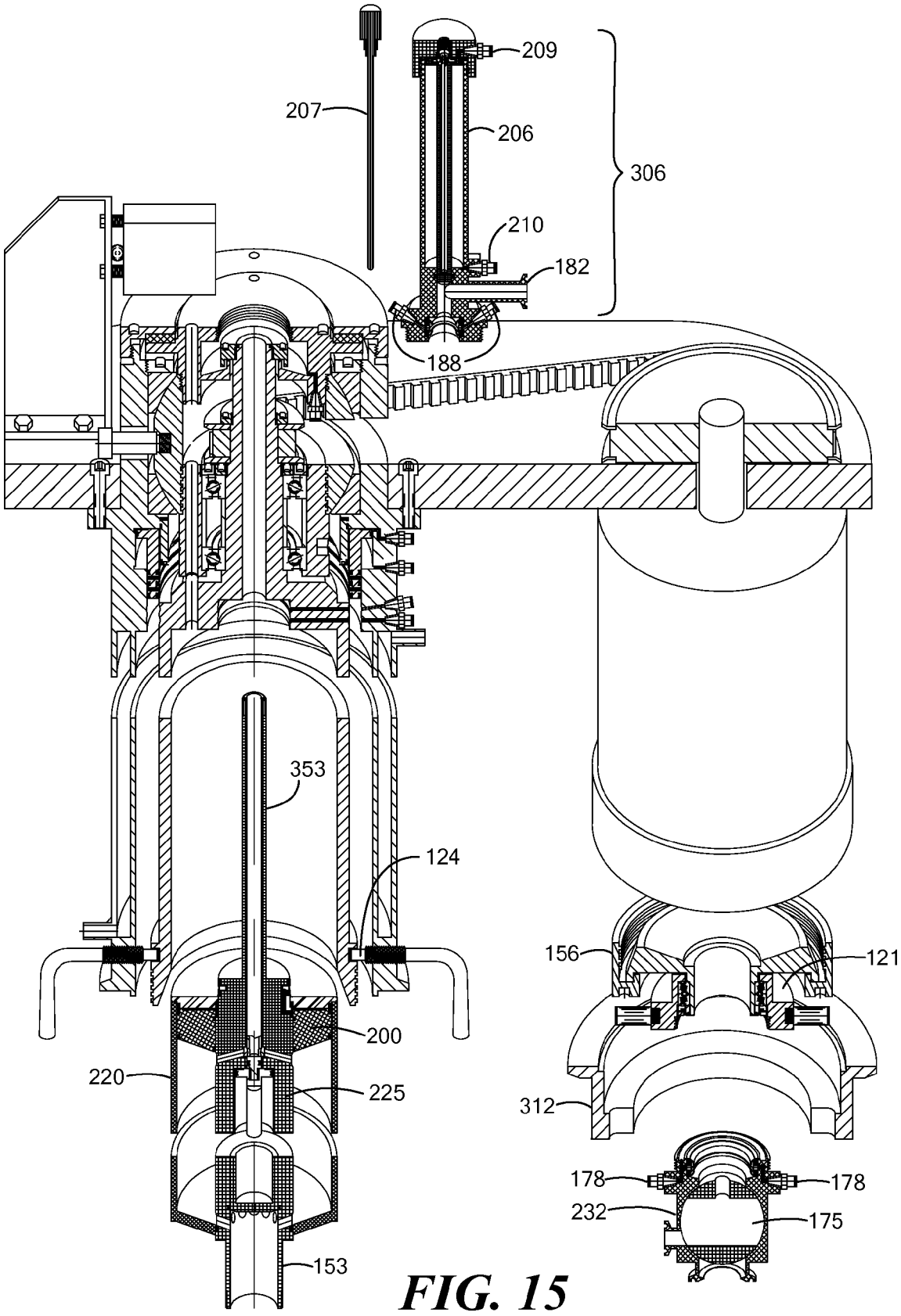
FIG. 15 is a section view of the separator in FIGS. 9A, 9B, and 9C following operation, in a disassembled configuration for replacement of disposable components.

FIG. 15 shows the separator of FIGS. 9A, 9B, and 9C disassembled for replacement of disposable parts between runs. Displacement transducer 207 is removed for reuse or replacement from the disposable centrate valve/second piston actuator assembly 306, which is replaced by a fresh, preferably sterile assembly. Similarly, feed/discharge valve assembly 232 is removed and replaced with a new, preferably sterile assembly. In order to replace the bowl liner and piston assembly, lower housing claim ring 112 and lower housing cap 312 are first removed. Then, once the bowl is locked in place by tightening lock handles 124, the lower bearing assembly 121 and bowl bottom lock nut 156 can be removed. This exposes the assembly containing bowl liner 200, first piston 200, central core 225, lower liner extension 153, and upper liner extension 353. The assembly is removed and replaced by a new, preferably sterilized assembly.

The invention also contemplates kits containing any combination of the disposable elements or assemblies used in a dual piston centrifugal separator according to the invention. For example, such a kit can contain any of the following, or any combination thereof: a disposable bowl liner, a disposable bowl liner/first piston assembly, a disposable separator bowl/bowl liner/first piston assembly, a disposable centrate valve assembly, a disposable second piston assembly, a disposable centrate valve/second piston assembly, or a disposable feed/discharge valve assembly. Such kits may also include instructions for installation and/or use of the provided disposable components in the separator.

Further, the invention contemplates methods of operating a dual piston centrifugal separator according to the invention, such as that depicted in FIGS. 9A, 9B, and 9C. One embodiment of such a method includes the following steps. In step (a), feed liquid is flowed or pumped into the separator bowl through an inlet port. The separator bowl contains a hollow central core, a first piston surrounding the core, and a second piston within the core. In step (b), the separator bowl is rotated through the action of a drive motor, and in the process, solid or denser components of the feed liquid accumulate on the inner surface of the bowl or bowl liner. In step (c), the separator bowl is continued to be rotated while feed liquid flows into the inlet port, resulting in the production of a clarified centrate liquid that flows out through an outlet port. In step (d), bowl rotation is stopped, and residual liquid is drained from the bowl through the inlet port. In step (e), a pressurized fluid, such as a drive gas, is introduced into the bowl, causing the first piston to be displaced downward within the bowl, and causing accumulated solids to be discharged through the inlet port. In step (f), an actuator for the second piston is driven downward, causing the second piston to move downward within the central core, and causing residual solids to be discharged through the inlet port. In optional step (g), a pressurized fluid or drive gas is introduced through the inlet port into the bowl, forcing the first piston to be displaced upward in the bowl, recreating the starting conditions for step (a). In some embodiments of the method, steps (a) through (g) are repeated for two or more cycles, which can be useful to process large amounts of a single feed liquid material, for example. In optional step (h), the separator is partially disassembled following step (f) or step (g), and one or more disposable components of the separator are replaced prior to repeating step (a). This is useful when switching the feed material to a different material, avoids cross-contamination between different types of feed material, and also helps to maintain sterility.

While the present invention has been described in conjunction with a preferred embodiment, one of ordinary skill in the art, after reading the foregoing specification, will be able to effect various changes, substitutions of equivalents and other alterations to the compositions, articles, methods and apparatuses set forth herein. For example, fluid pressure may be replaced in other embodiments by, without limitation, an electromechanical force. Similarly, the lower portion and end of the piston and bowl, respectively, may be non-conical in shape, although it is preferable for solids recovery that their shapes be complimentary. Valves can be operated manually or by, e.g., electrically or pressure-driven actuators.

Moreover, the invention also contemplates that the various passages, valves, pistons, actuators, assemblies, ports, members and the like described herein can be in any configuration or arrangement that would be suitable for operation of a centrifugal separator. The embodiments described above may also each include or incorporate any of the variations of all other embodiments. For example, the laser piston position sensor assembly described herein can be used in conjunction with any or all of the embodiments of the present invention. The centrifugal separator can be hermetically sealed or can lack hermetic seals. Various components, e.g., bowls, bowl liners, pistons, or valves, can be provided as separate items or combined with related items as a kit, including instructions for use with a separator or a method according to the invention. Furthermore, the embodiments described herein may also include any of the components or configurations described in any of U.S. Published Patent Application Nos. 2007-0049479 and 2007-0114161, U.S. Pat. Nos. 7,261,683, 7,052,451, and 6,986,734, all of which are incorporated by reference herein. It is therefore intended that the protection granted by Letter Patent hereon be limited only by the definitions contained in the appended claims and equivalents thereof.

What is claimed is:

1. A disposable separator bowl liner assembly for a centrifugal separator having a solids discharge centrifugal separator bowl comprised of a cylindrical upper bowl portion and a conical lower bowl portion, the assembly comprising:

a disposable bowl liner conforming to an inner wall of the solids discharge centrifugal separator bowl, the bowl liner comprising a cylindrical upper liner portion and a conical lower liner portion, the separator bowl comprising an inlet port at a bottom end and an outlet port at a top end, the bowl liner extending from the inlet port to the outlet port; and a piston within the bowl liner, the piston having an upper portion that conforms to the cylindrical upper portion of the bowl liner and a lower portion conforming to the conical lower portion of the bowl liner, the piston further having a fluid pathway between the bowl liner upper and lower portions, the piston movably disposed against an inner surface of the bowl liner.

2. The bowl liner assembly of claim 1, wherein the piston comprises a shuttle valve disposed within the fluid pathway within said piston, the shuttle valve regulating the direction of fluid flow through the fluid pathway in response to fluid pressure on either side of the valve.

3. The bowl liner assembly of claim 2, wherein the shuttle valve is substantially cylindrical.

4. The bowl liner assembly of claim 2, wherein the shuttle valve is substantially ball-shaped.

5. The bowl liner assembly of claim 2, wherein the fluid pathway has a first pathway portion coaxial with a central axis of the disposable bowl liner and extending from a top surface of the piston upper portion to a first upper portion of the shuttle valve and a second pathway portion extending radially from a second lower portion of the shuttle valve to an exterior surface of the piston lower portion.

6. The bowl liner assembly of claim 1, wherein the cylindrical upper liner portion further comprises a disposable upper valve assembly, the upper valve assembly providing a switchable fluid pathway between the outlet port of the bowl and a centrate port or an optical port, the upper valve assembly comprising one or more seals that hermetically seal the bowl interior during use; and the conical lower liner portion further comprises a disposable lower valve assembly, the lower valve assembly providing a switchable fluid pathway between the inlet port of the bowl and a feed liquid port or a solids discharge port, the lower valve assembly comprising one or more seals that hermetically seal the bowl interior during use.

7. The bowl liner assembly of claim 6, wherein the shuttle valve comprises a reflective upper surface configured to reflect a light beam passing through the disposable upper valve assembly.

8. The bowl liner assembly of claim 6, wherein one or both of the disposable upper valve assembly and the disposable lower valve assembly is a three-way ball valve.

* * * * *